US009254938B2

(12) United States Patent
Iwata et al.

(10) Patent No.: US 9,254,938 B2
(45) Date of Patent: Feb. 9, 2016

(54) PACKAGING CONTAINER WITH OPENING AND CLOSING LID

(71) Applicant: JAPAN TOBACCO INC., Tokyo (JP)

(72) Inventors: Shinichi Iwata, Tokyo (JP); Hirofumi Nakayama, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 14/447,880

(22) Filed: Jul. 31, 2014

(65) Prior Publication Data

US 2015/0014404 A1 Jan. 15, 2015

Related U.S. Application Data

(63) Continuation of application No. PCT/JP2012/081581, filed on Nov. 29, 2012.

(30) Foreign Application Priority Data

Feb. 1, 2012 (JP) ..... 2012-020264

(51) Int. Cl.

| | |
|---|---|
| ***B65D 5/00*** | (2006.01) |
| ***B65D 5/66*** | (2006.01) |
| ***B65D 85/10*** | (2006.01) |
| ***B65D 85/60*** | (2006.01) |
| *B65D 5/38* | (2006.01) |

(52) U.S. Cl.

CPC ..... *B65D 5/0085* (2013.01); *B65D 5/662* (2013.01); *B65D 85/1054* (2013.01); *B65D 85/60* (2013.01); *B65D 5/38* (2013.01)

(58) Field of Classification Search

USPC ..... 206/267, 270, 251; 229/129.1

See application file for complete search history.

(56) References Cited

U.S. PATENT DOCUMENTS

| | | | | |
|---|---|---|---|---|
| 3,311,283 | A * | 3/1967 | Shimada et al. | 229/125.08 |
| 3,933,299 | A | 1/1976 | Shimada et al. | |
| 3,977,520 | A * | 8/1976 | Grimm | 206/270 |
| 4,646,960 | A * | 3/1987 | Challand | 206/259 |
| 5,634,556 | A | 6/1997 | Focke et al. | |
| 7,658,280 | B2 | 2/2010 | Bardet et al. | |
| 2006/0070896 | A1 | 4/2006 | Focke et al. | |

(Continued)

FOREIGN PATENT DOCUMENTS

| | | | |
|---|---|---|---|
| JP | 8-58777 | A | 3/1996 |
| JP | 2005-523848 | A | 8/2005 |
| JP | 2009-292516 | A | 12/2009 |
| WO | WO 2007/065514 | A1 | 6/2007 |
| WO | WO 2007/122200 | A2 | 11/2007 |

(Continued)

*Primary Examiner* — Christopher Demeree

(74) *Attorney, Agent, or Firm* — Birch, Stewart, Kolasch & Birch, LLP

(57) ABSTRACT

A packaging container with an opening and closing lid, an opening is cut in an edge of the lid-raising member of a rear-side plate on a side of a lid-raising member of the inner case. A stopper is formed on part of the incision opening. An upper end edge of the stopper is an incision edge of the opening arranged at the lowest position of descent of an outer-case locking member and lower than a height position of inner-case locking member. The stopper approaches the outer-case locking member as the inner case moves upward. The outer-case locking member has at least a part of a stopper-corresponding portion in contact against the incision edge being the stopper, so that the outer-case locking member, which moves downward relative to the upward movement of the inner case, is in contact against the part that is the lowest position of descent thereof.

5 Claims, 32 Drawing Sheets

(56) References Cited

U.S. PATENT DOCUMENTS

| | | | |
|---|---|---|---|
| 2009/0008277 | A1 | 1/2009 | Agirbas |
| 2011/0062175 | A1 | 3/2011 | Nakamura et al. |

FOREIGN PATENT DOCUMENTS

| | | | |
|---|---|---|---|
| WO | WO 2013/068959 | A1 | 5/2013 |
| WO | WO 2013/114726 | A1 | 8/2013 |

* cited by examiner

PACKAGING CONTAINER WITH OPENING AND CLOSING LID

CROSS REFERENCE TO RELATED APPLICATIONS

This application is a Bypass Continuation of PCT International Application No. PCT/JP2012/081581 filed on Nov. 29, 2012, which claims priority under 35 U.S.C. §119(a) to Patent Application No. 2012-020264 filed in Japan on Feb. 1, 2012, all of which are hereby expressly incorporated by reference into the present application.

TECHNICAL FIELD

The present invention relates to a packaging container that has an opening and closing lid and stores small objects such as individually-packaged bar-shaped or plate-shaped small snacks, cigarette tobaccos, etc.

BACKGROUND ART

Conventionally, there are many packaging containers made from paper that store individually-packaged bar-shaped or plate-shaped chocolate snacks, cigarette tobaccos, etc. so that they can be taken out from a removal portion of the packaging containers. Among such packaging containers, ones that store the cigarette tobacco include packaging containers that are made from paper and cover the removal portion with an opening and closing lid.

As the above-described packaging container with the opening and closing lid, which is used for cigarette products, many packaging containers of a type, wherein an upper portion of the packaging container is formed as the opening and closing lid and the opening and closing lid is directly opened and closed by hand, are distributed on the market (see Patent Literature 1). Further, besides the above-described packaging container, there are packaging containers that are formed by an outer case having a rectangular cylindrical shape with open top and bottom ends or a bottomed rectangular parallelepiped outer case, in which an upper portion thereof is open as an insertion and removal opening, and by an inner case housed in the outer case having an opening and closing lid. Then, a number of packaging containers have been proposed in which the opening and closing lid opens and closes as the inner case is raised and lowered.

In a type of the packaging container in which the opening and closing lid opens and closes as the inner case is raised and lowered, a lid-raising member is provided that is connected to the opening and closing lid, and also the outer case is provided with a locking member that is folded back inward from the insertion and removal opening. Then, as the inner case moves upward, the lid-raising member also moves upward while being in sliding contact with an inner surface of the outer case and engages with the locking member of the outer case. Further, as a result of the inner case moving upward in a state in which the engagement between both of the members is maintained, the opening and closing lid is pulled by the lid-raising member and opens by setting a hinge portion as a center. Further, with respect to closing of the opening and closing lid, a structure is provided in which, when the opening and closing lid is lowered so as to enter inside the outer case, an upper portion of the lid-raising member (on a side of the opening and closing lid) or a rear plate portion of the opening and closing lid is pushed and raised up while being in contact against an opening edge of the insertion and removal opening of the outer case, thereby the opening and closing lid closes (Patent Literatures 2, 3, and 4, for example).

CITATION LIST

Patent Literature

Patent Literature 1: Japanese Patent Application Laid-Open No. Hei. 08-058777

Patent Literature 2: Pamphlet of International Publication No. 2007/065514

Patent Literature 3: Pamphlet of International Publication No. 2007/122200

Patent Literature 4: Japanese Patent Application Laid-Open No. 2009-292561

DISCLOSURE OF THE INVENTION

Problems that the Invention is to Solve

By the way, in each of packaging containers shown in Patent Literatures 2 to 4 provided with an opening and closing lid that opens and closes as the inner case is raised and lowered, the following troubles are likely to be caused. Those points will be described below.

FIG. 28 to FIG. 31 show a general packaging form, in which as an inner case b in a packaging container a slides upward from inside an outer case c, an opening and closing lid d in an upper end portion of the inner case b opens in response to the upward movement of the inner case b, and schematically illustrate an engagement between lid-raising means e in the packaging container a and locking means f on a side of the outer case. The lid-raising means e is a roughly plate-shaped body that is formed by cutting a packaging material of the inner case b. The lid-raising means e has a part in a lower portion thereof, and in that part, the lid-raising means e is folded back and can be locked to a side plate h side of a body portion g of the outer case c, with the lid-raising means e facing the outer case c (FIG. 28). Further, the locking means f on the side of the outer case has been generally formed by folding back a tongue piece toward the inner case b, the tongue piece being provided continuously to an upper end edge of the side plate h of the outer case c on a side of an insertion and removal opening i (FIG. 29).

Then, when opening the opening and closing lid d, the inner case b is slid upward using a tip of a finger through a slide operation opening (refer to Patent Literature 4) in the body portion g of the outer case c, for example, the slide operation opening not being shown in the figures. The slide-up operation causes a folded-back lower portion j of the lid-raising means e and the locking means f on the side of the outer case to engage with each other, and as described above, the lid-raising means e engaged with the locking means f on the side of the outer case moves downward relative to the inner case b, which slidingly moves upward, so as to lift up the opening and closing lid d and to cause a removal opening for a stored object provided in an upper portion of the inner case b to be opened (FIG. 30 to FIG. 32).

However, when the lid-raising means engages with the locking means on the side of the outer case and moves downward relative to the inner case, a tensile force is generated in the lid-raising mean, and the lid-raising means, in which the tensile force is generated, is in contact against an opening side k on the insertion and removal opening side of the outer case, which results in pushing the opening side k from inside the container so as to warp the opening side k outward (in the direction of a lateral-facing arrow in FIG. 32). Then, a side plate of the body portion, in which the locking means on the side of the outer case is provided, is deformed while being expanded so that a gap between the side plate, in which the locking means on the side of the outer case is provided, and the inner case is widened and the lower portion of the lid-raising means also approaches the side of the side plate h of the outer case.

As a result of the inner case sliding upward in a state in which the above-described gap is widened, as shown by a downward arrow in FIG. 32, it becomes possible that the lower portion j of the lid-raising means e moves further downward in a relative manner on an outer surface side of the inner case b, and even when the removal opening of the inner case is sufficiently open, the inner case b is operated to be slid upward more than necessary. Then, as a result of the inner case moving upward more than necessary, there has been a problem in which stress is concentrated on such portions as a hinge portion, which connects an upper end of the inner case with the opening and closing lid, and a continuous portion, which connects an upper portion of the lid-raising means with the opening and closing lid, and a rip is caused in such portions.

The packaging container shown in Patent Literature 3 has a structure in which a pair of folded-back pieces are provided on a rear plate of the inner case, the folded-back pieces being formed by cutting the rear plate, as a purpose to receive the folded-back lower portion of the lid-raising means that moves downward in a relative manner. However, even in this packaging container, the above-described tensile force is generated in the lid-raising means that is continuous to a rear side of a portion that forms the opening and closing lid, and the side plate of the body portion of the outer case is still easily deformed while being expanded in the same manner as described above. Then, the gap between the side plate of the outer case, in which the locking means on the side of the outer case is provided, and the inner case is widened, and as a result, when the lower portion of the lid-raising means approaches the side plate of the outer case, an engagement between the lower portion of the lid-raising means and the folded-back pieces cannot be formed. Further, as a result of the movement, namely, the movement in which the lower portion of the lid-raising means approaches the side plate of the outer case, there is a possibility that the folded-back pieces become unfolded and are thus not able to receive the lower portion of the lid-raising means.

In view of the foregoing situation, the present invention takes advantage of the useful point of the above-described packaging container in which the inner case is moved upward in a state in which the lid-raising means and outer-case locking means engage with each other and the opening and closing lid rotates in the opening direction so that the inner case with an open storage portion advances upward. At the same time, the present invention provides a packaging container that is capable of making the outer-case locking means be in contact against a portion that forms the lowest position of descent thereof, the outer-case locking means moving downward relative to the upward movement of the inner case, and of inhibiting the inner case from moving upward from the outer case more than necessary even when the slide-up operation is performed. An object of the present invention is to inhibit the hinge portion, which forms a rotational center of the opening and closing lid, from being damaged.

Means for Solving the Problem

The present invention was made in view of the above-described problems and provides a packaging container with an opening and closing lid, the packaging container comprising an outer case of a rectangular parallelepiped shape having an insertion and removal opening in an upper portion thereof and an inner case which is slidably housed in the outer case, can be inserted and removed from the insertion and removal opening, and has an opening and closing lid, a lower portion of which is rotatably connected to the inner case via a first hinge. The packaging container includes lid-raising means which has an upper portion connected to a rear end of the opening and closing lid via a second hinge, can move relative to the inner case as the opening and closing lid rotates, and has inner-case locking means arranged therein on a side facing an inner surface of the outer case, and outer-case locking means which is positioned on an inner side of the outer case and can be engaged with the inner-case locking means. The packaging container with the opening and closing lid is configured such that the inner-case locking means and the outer-case locking means engage with each other as the inner case moves upward, and the lid-raising means moves downward as the inner case moves upward in a state in which the inner-case locking means and the outer-case locking means engage with each other so that the opening and closing lid rotates in an opening direction. The packaging container with the opening and closing lid is characterized in that an incision opening is formed by cutting a part corresponding to an edge of the lid-raising means in a side plate on a side of the lid-raising means of the inner case, that a stopper is formed in a part of the incision opening below a height position of the inner-case locking means with an upper end edge of the stopper being an incision edge arranged at the lowest position of descent of the outer-case locking means, and that a width of the outer-case locking means is wider than that of the stopper, and at least part of a stopper-corresponding portion of the outer-case locking means, which the stopper approaches as the inner case moves upward, is contact against the incision edge being the stopper. The present invention solves the above-described problems by providing the above packaging container.

According to an embodiment of the present invention, it is preferable that guiding means for guiding the stopper-corresponding portion of the outer-case locking means toward the stopper be provided in the inner case.

According to an embodiment of the present invention, it is preferable that the guiding means be provided in the lid-raising means and guides the inner-case locking means toward the stopper while being slidably in contact with an inner surface of the inner case, the inner-case locking means approaching the stopper as the inner case moves upward.

According to an embodiment of the present invention, it is preferable that the guiding means presses against the inner-case locking means toward an inner side of the inner case.

According to an embodiment of the present invention, it is preferable that a backing plate be arranged on an inner surface of a side plate, in which the lid-raising means of the inner case is provided, the backing plate covering the lid-raising means and the incision opening formed around the edge of the lid-raising means.

According to an embodiment of the present invention, it is preferable that a slide operation opening be opened in a body portion of the outer case so that part of the inner case is exposed from the slide operation opening, thereby being enabled to perform a slide-up operation with respect to the exposed part of the inner case.

Effects of Invention

According to an embodiment of the present invention, in the outer-case locking means that has the width wider than that of the stopper, the stopper-corresponding portion of the outer-case locking means is in contact against the incision edge being the stopper.

In this manner, as the stopper is in contact against the incision edge provided in the side plate of the inner case, the inner case does not move upward more than necessary, when the lid-raising means, which is engaged with the outer-case locking means as the inner case moves upward, moves downward relative to the inner case, and the outer-case locking means is in contact against the incision edge of the stopper when the outer-case locking means reaches the lowest position of descent thereof.

As a result, it is possible to inhibit the above-described damage to the hinge portion of the opening and closing lid. Further, as a sensation (a sense of striking) generated when the outer-case locking means is in contact with against the incision edge is transmitted to a tip of a finger that is performing the slide-up operation of the inner case, it is possible for a user to know a limit of the slide-up operation of the inner case. Therefore, it is possible to significantly improve usability of the packaging container by making it possible to eliminate an unnecessary slide-up operation, for example.

According to an embodiment of the present invention, as the guiding means guiding the stopper-corresponding portion of the outer-case locking means, which approaches the stopper as the inner case moves upward, toward the stopper is provided in the inner case, an advantageous effect is achieved in which the contact between the outer-case locking means, which has moved downward to the lowest position of descent thereof, and the stopper can be performed more reliably.

According to the invention of claim 3, the guiding means is provided in the lid-raising means and guides the inner-case locking means toward the stopper while being slidably in contact with the inner surface of the inner case, the inner-case locking means approaching the stopper as the inner case moves upward. As the guiding means is provided in the lid-raising means, the guiding means can be obtained at the same time when the lid-raising means itself is formed without using separate members other than the outer case and the inner case, and it becomes easy to create the guiding means.

According to an embodiment of the present invention, as the guiding means presses against the inner-case locking means toward the inner side of the inner case, the contact between the stopper-corresponding portion of the outer-case locking means and the stopper is achieved more reliably, the outer-case locking means being received by the inner-case locking means.

According to an embodiment of the present invention, as the backing plate is arranged on the inner surface of the side plate in which the lid-raising means of the inner case is provided and the backing plate covers the lid-raising means and the incision opening being formed by cutting the edge of the lid-raising means, an interference is reliably inhibited between the outer-case locking means, which moves downward relative to the upward movement of the inner case, or the lid-raising means, which moves downward while engaging with the outer-case locking means, and a stored object. Further, movements of the outer-case locking means and the lid-raising means are appropriately maintained, and it is possible to inhibit an obstacle from leaking out of the inner case side to the outer case side, the obstacle causing a trouble in the engagement between the outer-case locking means and the inner-case locking means.

According to an embodiment of the present invention the invention of claim 6, the slide operation opening is opened in the body portion of the outer case and the part of the inner case is exposed from the slide operation opening so as to be enabled to perform the slide-up operation with respect to the exposed part of the inner case. Therefore, an operation of moving the inner case upward and downward can be performed using the tip of the finger of a hand holding the packaging container, so that an excellent effect is achieved in which it becomes easy to perform an operation of removing a stored object from the packaging container, for example.

BEST MODE FOR CARRYING OUT THE INVENTION

Figure 1:
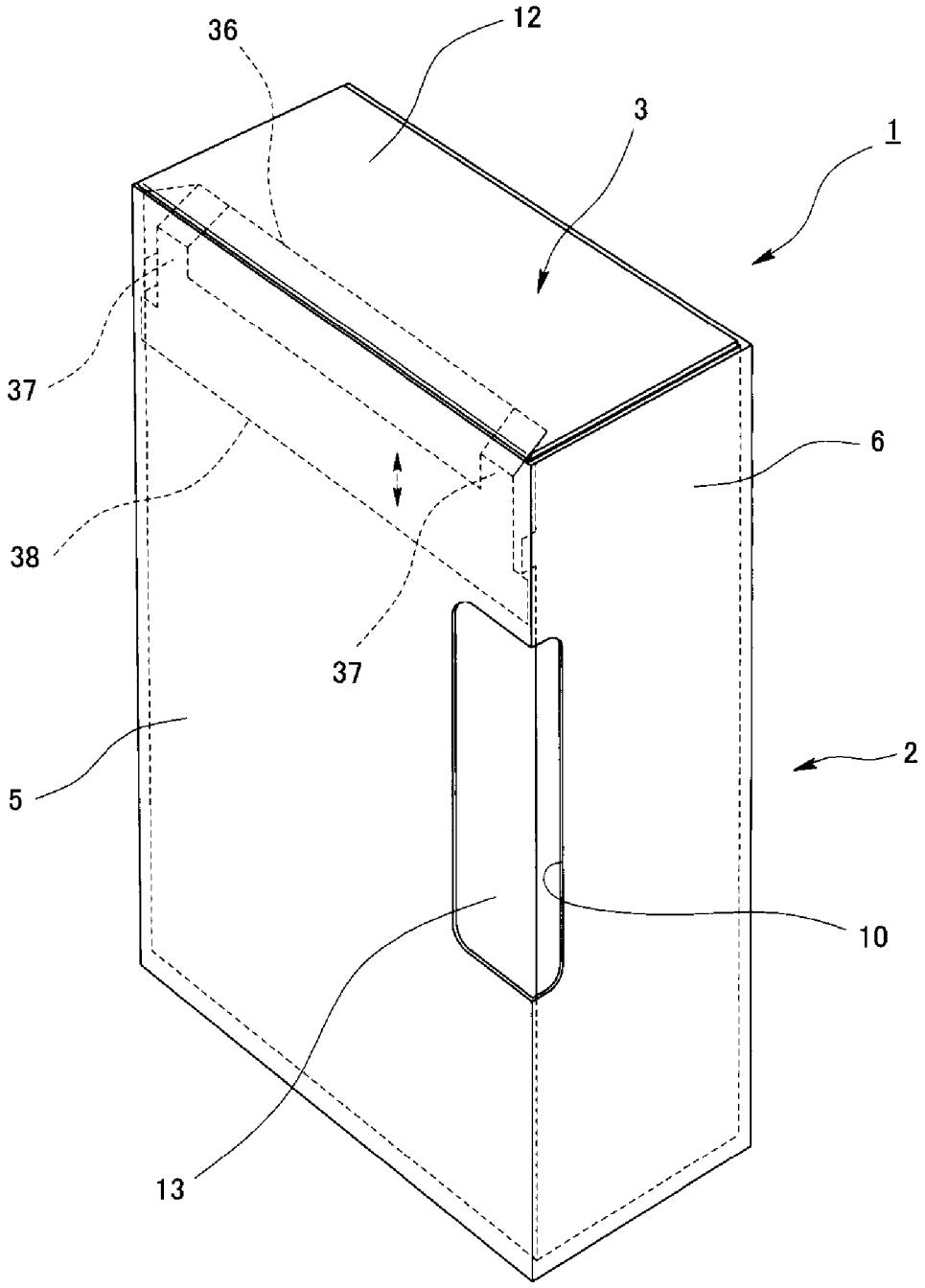
FIG. 1 is an illustrative diagram showing a state viewed from above in which an opening and closing lid is closed in a first embodiment.

Next, the present invention will be described in detail on the basis of embodiments shown in FIG. 1 to FIG. 27. Note that the embodiments illustrate a packaging container used for a purpose of storing a cigarette tobacco as a stored object.

FIG. 1 to FIG. 12 show a first embodiment. Reference numeral 1 represents a packaging container with an opening and closing lid according to the present invention, and the packaging container 1 is formed by an outer case 2 made from paper, which is formed by folding and assembling one sheet of a blank, and an inner case 3 made from paper, which is formed by folding and assembling one sheet of a blank in the same manner.

Figure 5:
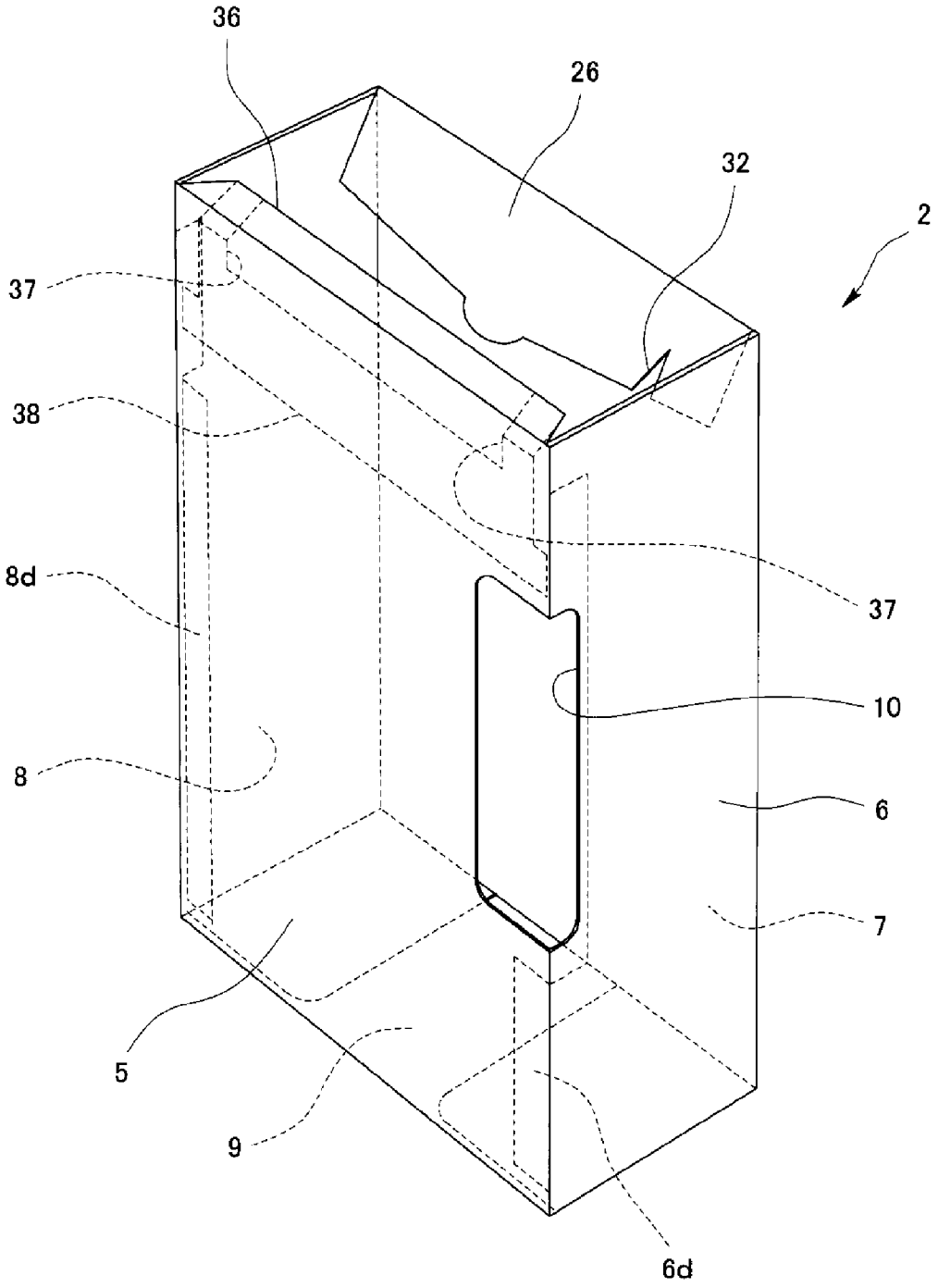
FIG. 5 is an illustrative diagram showing an outer case in the first embodiment.

(Outer Case: FIG. 5)

The outer case 2 is bottomed and has a rectangular parallelepiped shape having an insertion and removal opening 4 in an upper portion thereof. Around a body portion of the outer case 2, a front-side plate 5, a right-side plate 6, a rear-side plate 7, and a left-side plate 8 are provided continuously to one another, and a bottom-surface plate 9 is made to be continuous to a lower end of each of the side plates. Then, the outer case 2 slidably houses the inner case 3, an upper portion side of the inner case 3 can be inserted and removed from the insertion and removal opening 4, and a slide operation opening 10 is opened across from the front-side plate 5 to the right-side plate 6 on the one side in the body portion of the outer case 2. Part of the inner case 3 is exposed from the slide operation opening 10 so that it is possible to cause the inner case 3 to be raised and lowered by sliding up or sliding down the exposed portion of the inner case 3 using a tip of a finger.

Figure 2:
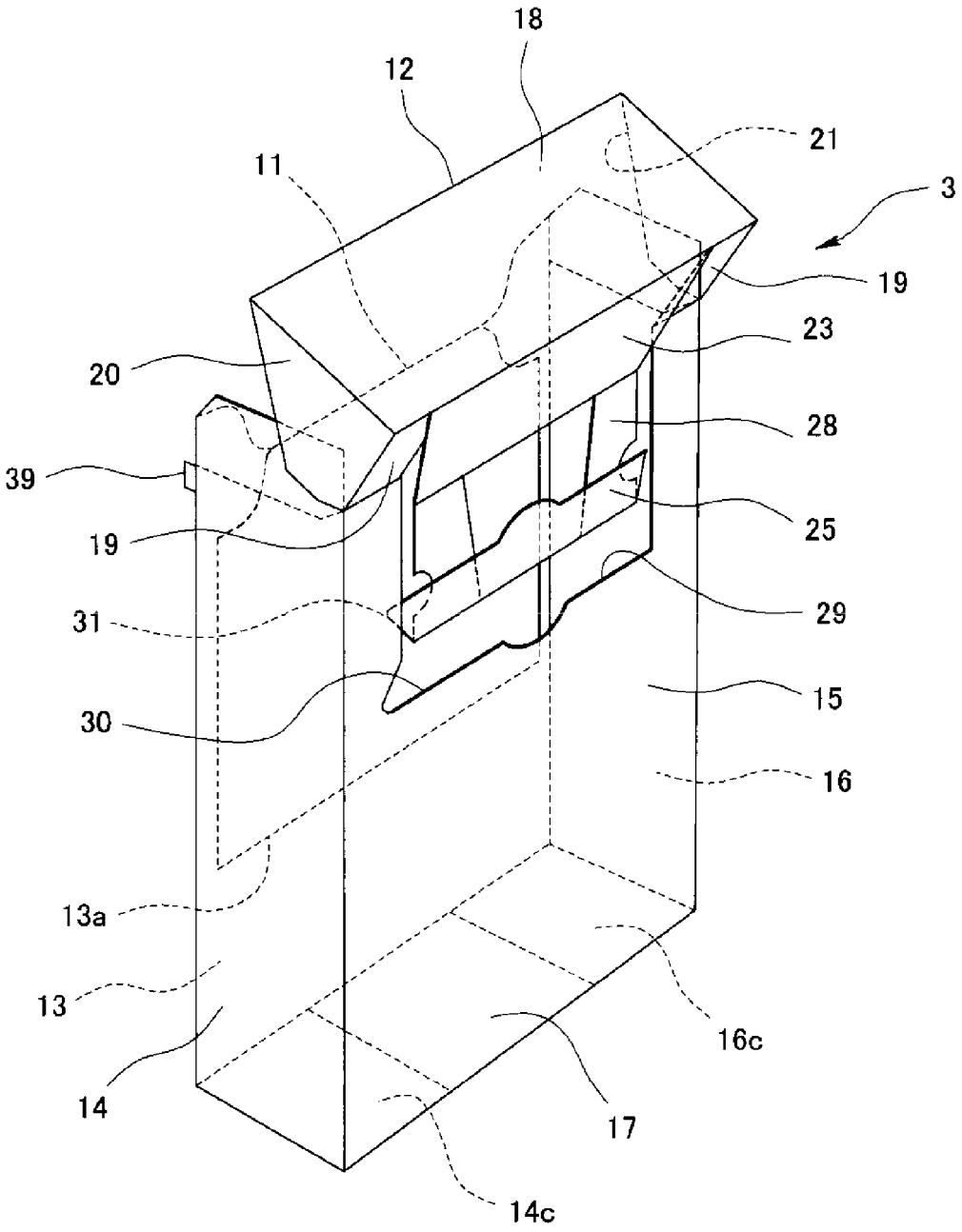
FIG. 2 is an illustrative diagram showing an inner case in the first embodiment.
Figure 3:
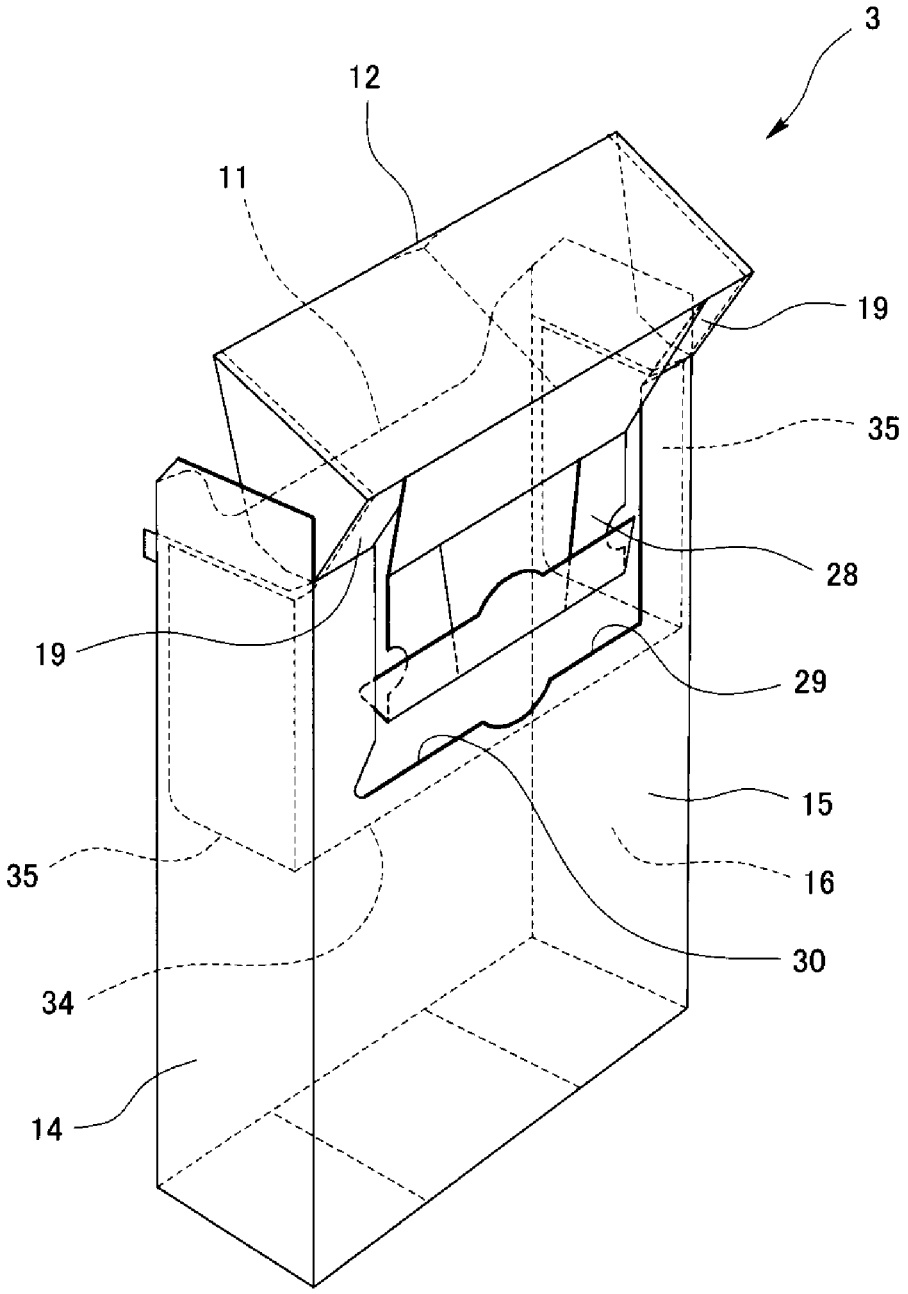
FIG. 3 is an illustrative diagram showing lid-raising means and a backing plate of the inner case in the first embodiment.
Figure 4:
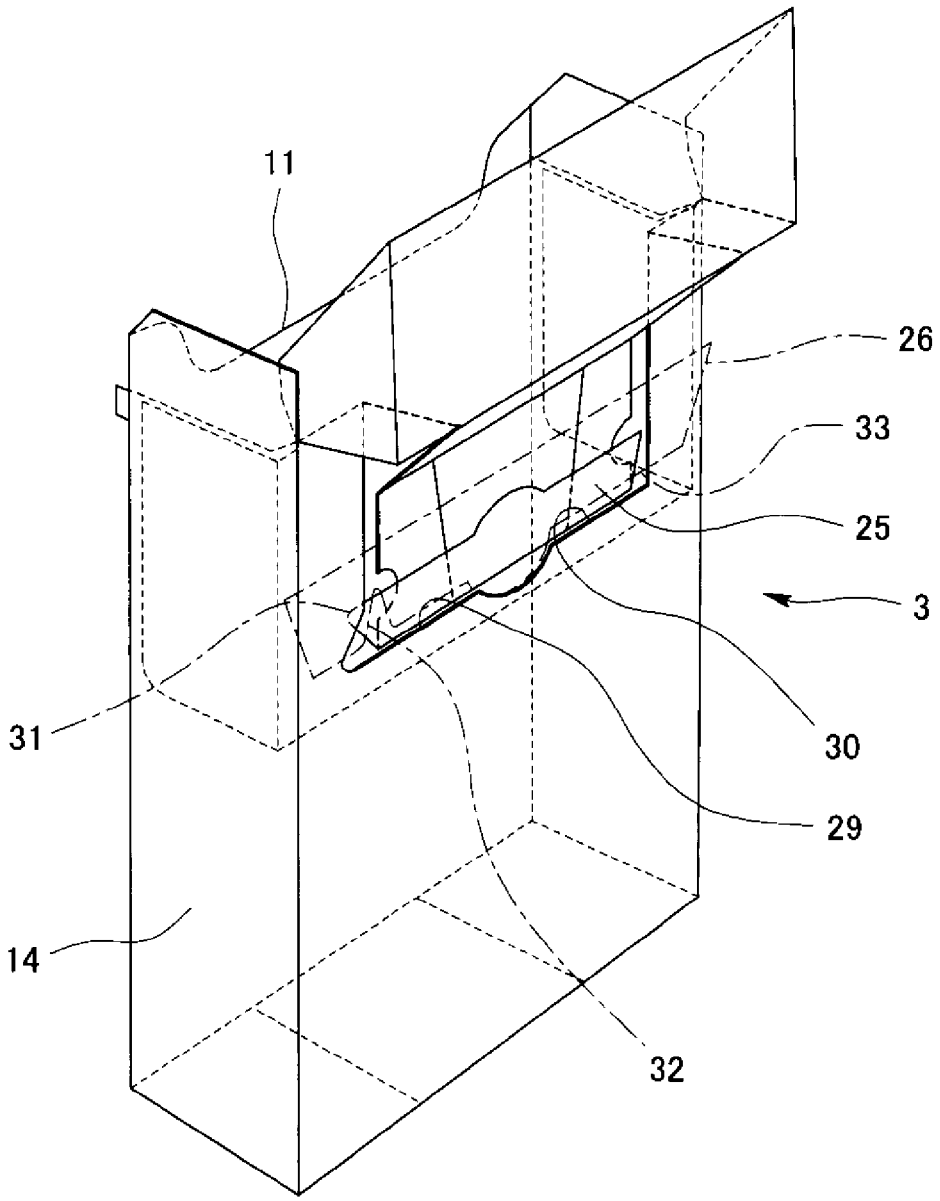
FIG. 4 is an illustrative diagram showing inner-case locking means that has descended in the inner case in the first embodiment and outer-case locking means that engages with the inner-case locking means.

(Inner Case: FIG. 2 to FIG. 4)

The inner case 3, which is slidably housed in the outer case 2, also has the same bottomed rectangular parallelepiped shape. The inner case 3 has a removal opening 11 for taking out a stored object in an upper portion thereof and has an opening and closing lid 12 that covers an upper side of the removal opening 11 when the removal opening 11 is in a state of being retracted inside the outer case 2 (refer to FIG. 2). The inner case 3 has a front-side plate 13, a right-side plate 14, a rear-side plate 15, and a left-side plate 16 provided continuously around a body portion thereof, and a bottom-surface plate 17 is continuous to a lower end of each of the side plates of the body portion. The inner case 3 is bottomed and has the removal opening 11 in the upper portion thereof. The front-side plate 13 has a shape in which a central portion of an upper end portion thereof is depressed. Further, the right-side plate 14 and the left-side plate 16 are shaped in a manner such that respective upper end portions are positioned above the upper end portion of the front-side plate 13. Further, an upper end portion of the rear-side plate 15 is cut toward a lower portion side thereof while leaving left and right end portions thereof uncut respectively (lid-raising means, which will be described below, is arranged in the cut and opened portion).

As shown in FIG. 2, the opening and closing lid 12 of the inner case 3 has rear-side plates 19 that are continuous to both sides of a rear end portion of a top-surface plate 18. Also, on side portions of the top-surface plate 18, a right-side plate 20 and a left-side plate 21 are continuously provided that are continuous to the rear-side plates 19, respectively. Then, a first hinge 22 is formed between each of the lower portions of the rear-side plates 19 and the upper end portion of the rear-side plate 15 of an inner case body portion, the upper end portion having an upwardly convex shape. The opening and closing lid 12 is rotatably connected to the inner case body portion of the inner case 3 via the first hinges 22. In the packaging container 1 that is used for the purpose of storing a cigarette tobacco, when the removal opening 11 of the inner case 3 is closed in a form in which it is combined with the outer case 2, upper portions of the left-side and right-side plates 14 and 16 of the inner case 3 overlap with the left-side and right-side plates 20 and 21 of the opening and closing lid 12. As a result, it becomes difficult for tobacco leaves to leak out of either side of the bent down opening and closing lid 12.

(Outer-Case and Inner-Case Locking Means)

As described above, the packaging container 1, which includes the outer case 2 and the inner case 3 that is slidably housed in the outer case 2, has a mechanism in which the opening and closing lid 12 opens and closes as the inner case 3 is raised and lowered and the opening and closing lid 12 is rotated in the opening direction in conjunction with the upward movement of the inner case 3. First, the inner case 3 has lid-raising means 23. As shown by a blank of the inner case 3, the lid-raising means 23 is connected to a rear end side of the opening and closing lid 12 via a second hinge 24 that is positioned above the first hinge 22. The lid-raising means 23 extends up to an opening portion of the rear-side plate 15, the opening portion being formed by cutting the rear-side plate 15 from a side of the opening and closing lid 12, and has a shape in which a lower portion thereof is folded back toward the rear-side plate 7 of the outer case 2.

Describing the shape of the lid-raising means 23 schematically, the lid-raising means 23 is formed by cutting a portion across from the rear end of the opening and closing lid 12 to the rear-side plate 15 of the inner case 3 as shown in the form of the blank of the inner case 3. Further, the lower portion of the lid-raising means 23 is folded back toward the rear-side plate 7 of the outer case 2, and the lower portion is formed as inner-case locking means 25. Further, around the lid-raising means 23, an opening portion is formed by cutting the edge thereof, and the opening portion is continuous to a portion cut from a rear end portion of the opening and closing lid 12. Therefore, there is no portion at which the lid-raising means 23 and the rear-side plate 15 are directly connected to each other, so that the lid-raising means 23 can move upward and downward as the opening and closing lid 12 rotates.

Figure 9:
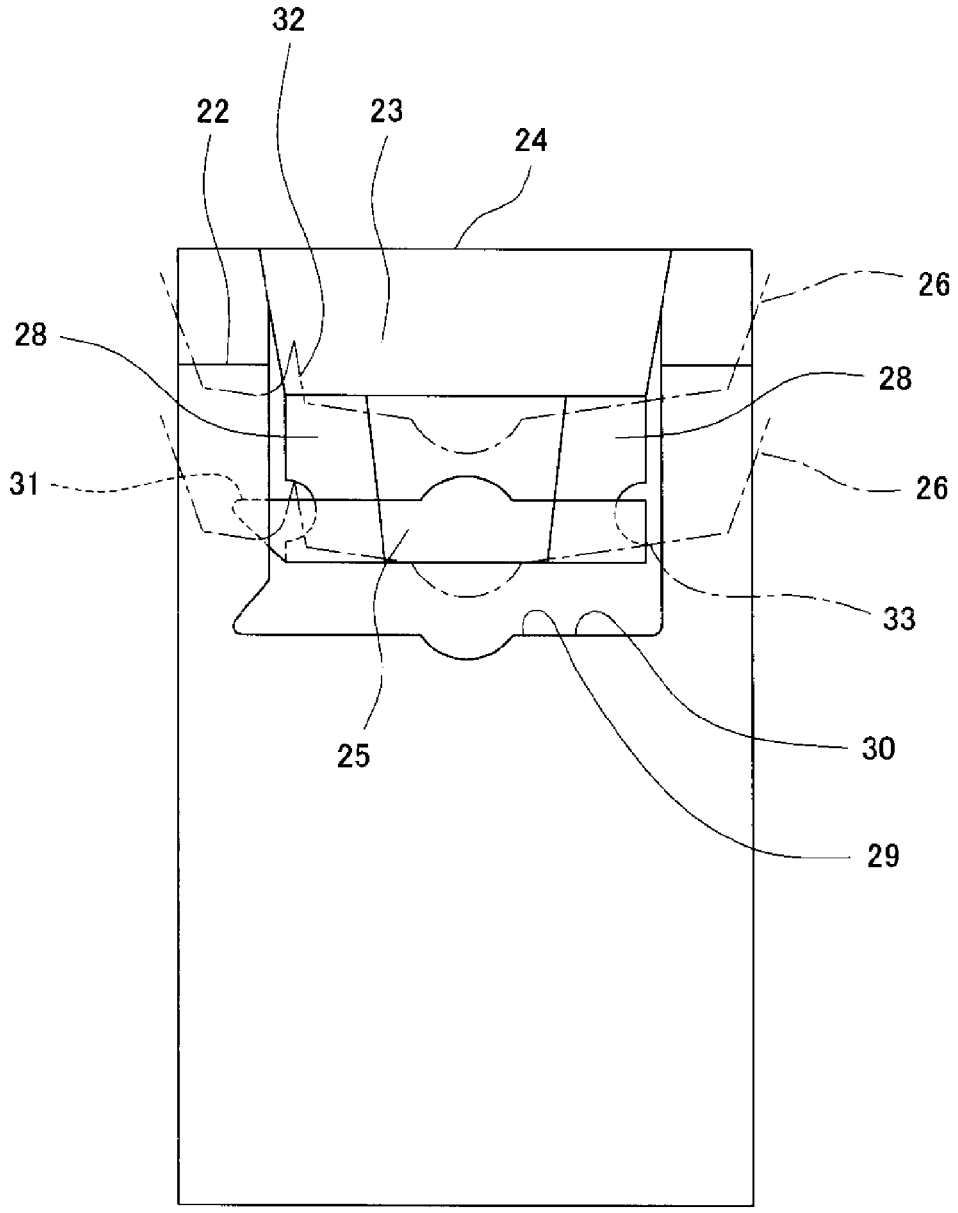
FIG. 9 is an illustrative diagram showing a relative movement of the outer-case locking means with respect to the inner-ease locking means at a time when the inner case moves upward in the first embodiment.
Figure 10:
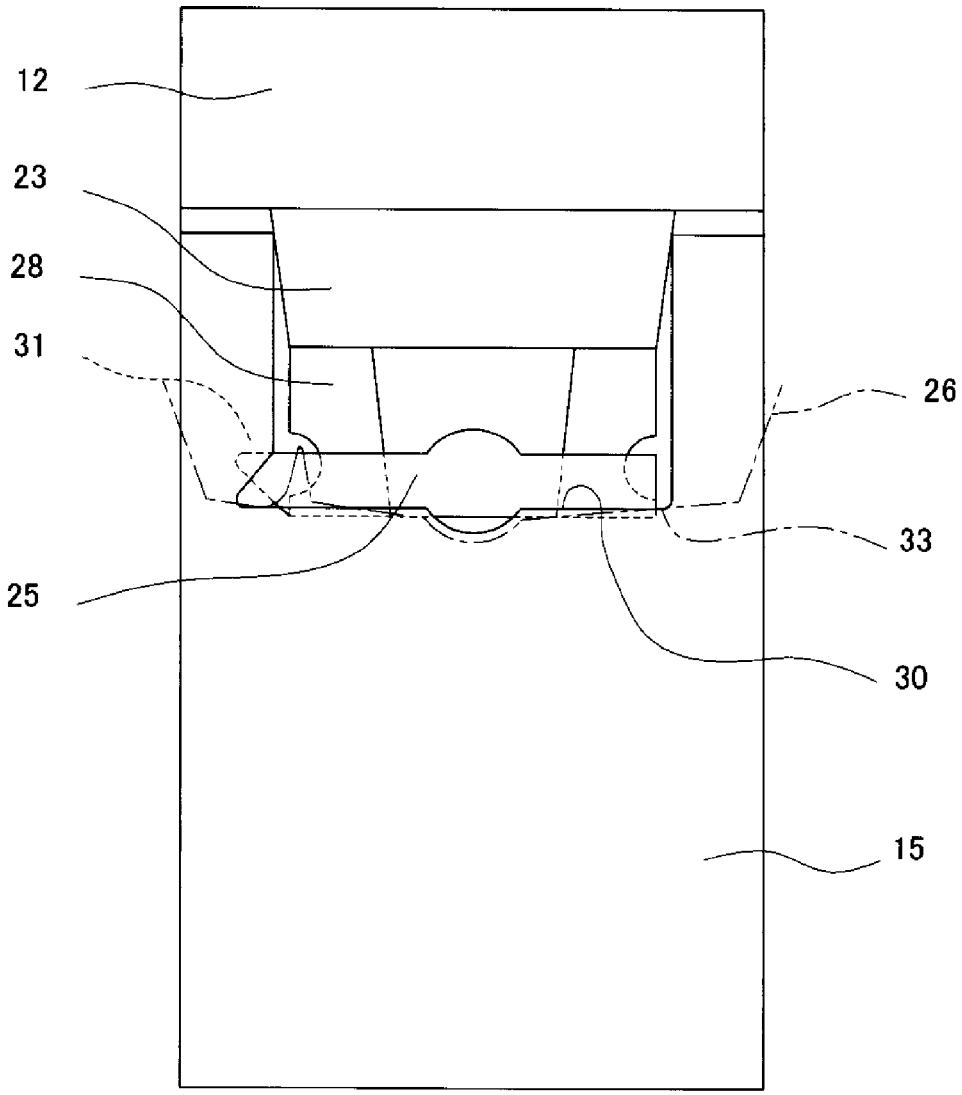
FIG. 10 is an illustrative diagram showing a contact between the outer-case locking means and a stopper in the first embodiment.

More specifically, these components are provided such that the rotation of the opening and closing lid 12 around the first hinge 22 and the upward and downward movement of the lid-raising means 23 are performed in conjunction with each other. Furthermore, when the opening and closing lid 12 rotates in the opening direction, the lid-raising means 23 moves downward relative to a rear-side plate 15 of the inner case 3 (FIG. 9, FIG. 10). The shape of the folded-back inner-case locking means 25 may be any shape as long as the inner-case locking means 25 receives outer-case locking means, which will be described below. Also, the inner-case locking means 25 may have any shape as long as a hook-like portion can be formed by folding the same as shown in respective embodiments described below.

Figure 6:
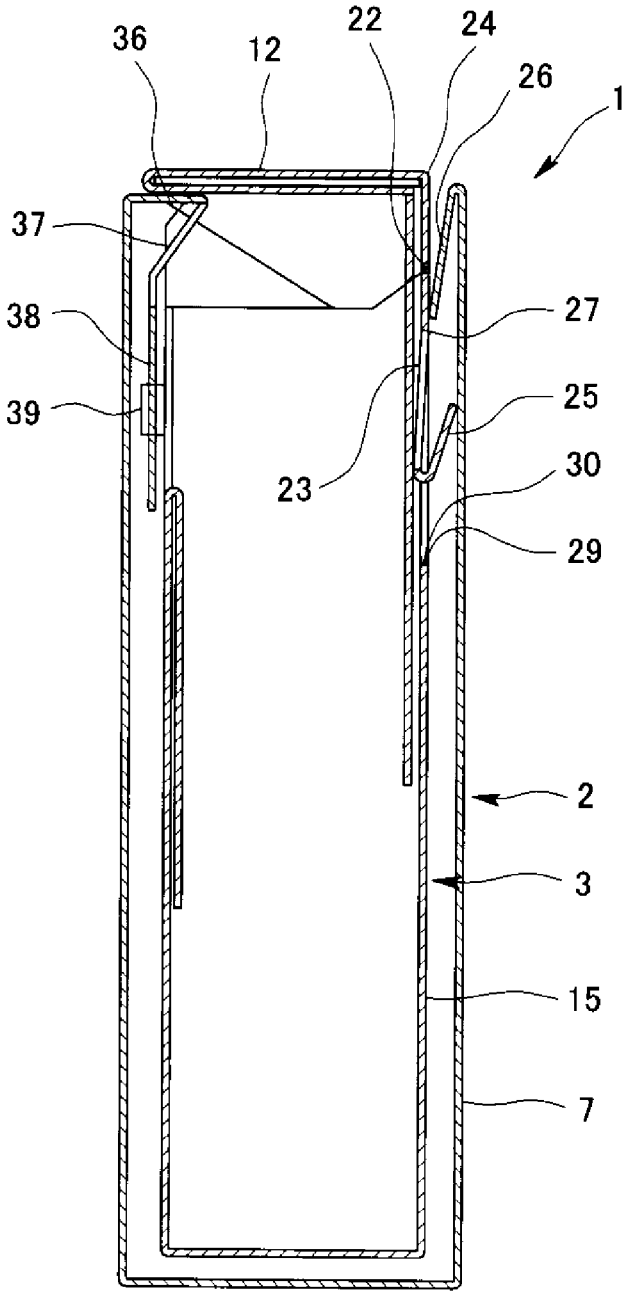
FIG. 6 is an illustrative diagram showing a state in which the inner case is housed in the outer case, the opening and closing lid is bent down, and an insertion and removal opening is closed in the first embodiment.
Figure 7:
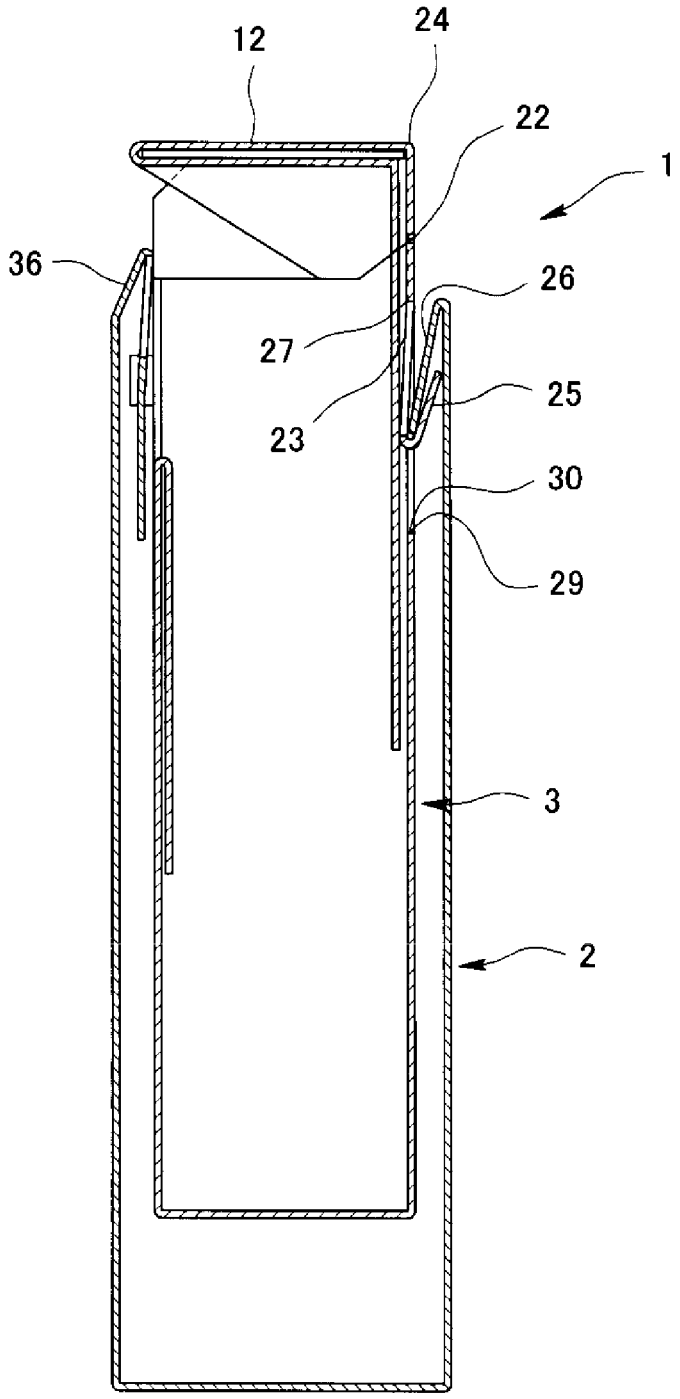
FIG. 7 is an illustrative diagram showing a state in which the inner case moves upward and the lid-raising means and the outer-case locking means engage with each other in the first embodiment.
Figure 8:
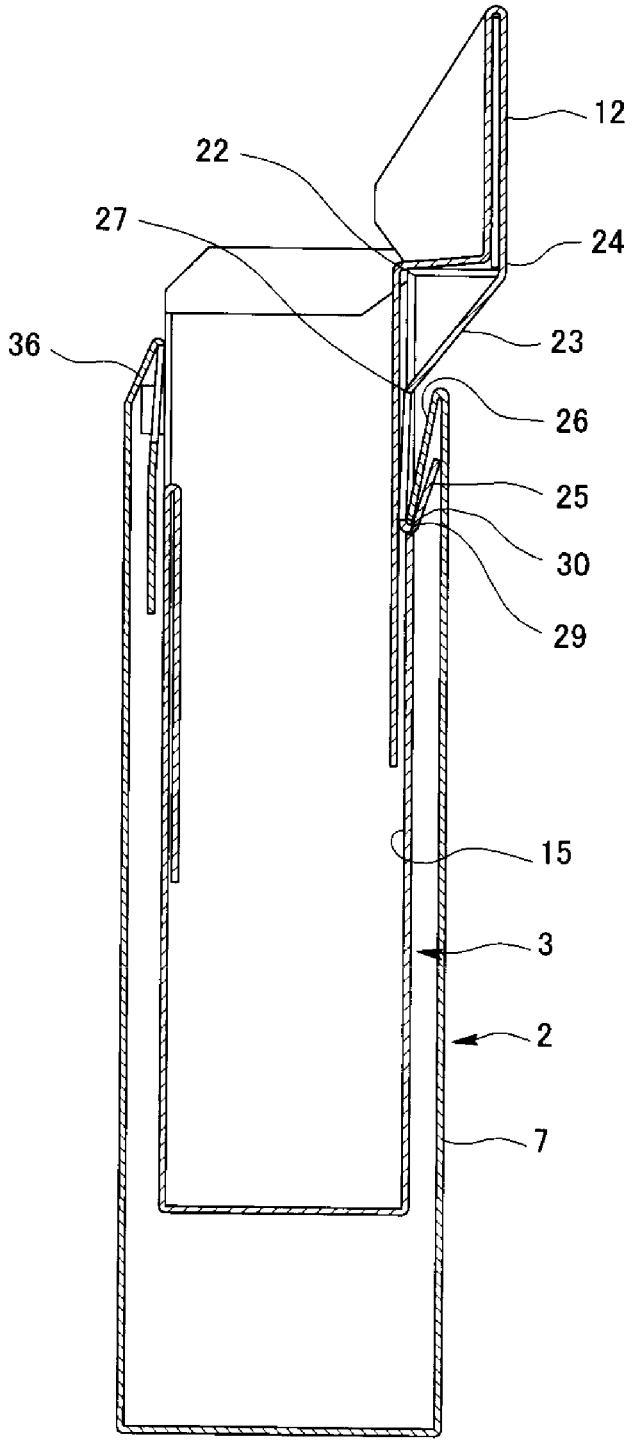
FIG. 8 is an illustrative diagram showing a state in which the opening and closing lid is open in the first embodiment.

On the other hand, in the outer case 2, a tongue piece that is provided continuously to an upper end portion of the rear-side plate 7 is folded down toward an inner side of the outer case 2 to serve as outer-case locking means 26. The outer-case locking means 26 is provided so as to engage with the lid-raising means 23, which moves upward while a part thereof is in sliding contact with an inner surface side of the rear-side plate 7, when the inner case 3 slides upward (FIG. 9, FIG. 10). A lower edge portion of the outer-case locking means 26 is locked with the folded inner-case locking means 25 of the lid-raising means 23 in a manner in which the lower edge portion of the outer-case locking means 26 enters into the folded inner-case locking means 25. Then, in a state in which the lid-raising means 23 and the outer-case locking means 26 engage with each other, the inner case 3 continues to move upward. As a result, the lid-raising means 23 results in moving downward relative to the inner case body portion, the rear end portion of the opening and closing lid 12 is pulled via the second hinge 24, and the opening and closing lid 12 rotates in the opening direction around the first hinge 22 (FIG. 6 to FIG. 8).

In the lid-raising means 23, a third hinge 27 is provided in a portion positionally corresponding to the upper end portion of the rear-side plate 7 of the outer case 2 in a state in which the lid-raising means 23 engages with the outer-case locking means 26. The third hinge 27 allows the lid-raising means 23 to be folded at a position of the third hinge 27 when the opening and closing lid 12 rotates in the opening direction. Due to the folding of the third hinge 27, turning around of the opening and closing lid 12 is performed smoothly.

(Locking Means)

FIG. 9 and FIG. 10 show the lid-raising means 23 in a state in which the rear-side plate 15 of the inner case 3 is viewed from outside the container. As shown in the figures, in the lid-raising means 23, leg-like portions 28 are provided on both sides below the third hinge 27, and the inner-case locking means 25 is arranged across a portion between lower edges of the leg-like portions 28. The inner-case locking means 25 is formed by folding a lower end portion of the lid-raising means 23 toward the rear-side plate 7 of the outer case 2 from a folding line formed along the lower edges of the leg-like portions 28, and a central convex portion of the inner-case locking means 25 is in contact against an inner surface of the rear-side plate 7 of the outer case 2 while being slidably in contact with the inner surface. Then, when the inner case 3 is not moved upward, the inner-case locking means 25 and the outer-case locking means 26 are in a non-engagement state, being separated vertically in the height direction of the container. As the inner case 3 moves upward, the lid-raising means 23 (the inner-case locking means 25) moves upward so that the inner-case locking means 25 and the outer-case locking means 26 enter a state of engagement (FIG. 6 to FIG. 8).

As described above, by making the inner case 3 move upward by a slide-up operation through the slide operation opening 10 of the outer case 2, the lid-raising means 23 and the outer-case locking means 26 engage with each other. Further, by making the inner case 3 move upward in the engagement state, the lid-raising means 23 moves downward relative to the rear-side plate 15 of the inner case 3, and the opening and closing lid 12 is pulled in the opening direction by the lid-raising means 23. Then, both the inner-case locking means 25 of the lid-raising means 23 and the outer-case locking means 26 move downward relative to the rear-side plate 15 of the inner case 3 that moves upward. Then, when the opening and closing lid 12 is rotated in the opening direction up to an angle that causes an upper side of the removal opening 11 to be fully open, it is necessary to stop the lid-raising means 23 and the outer-case locking means 26 from moving downward, and the position is set in advance as a lowest position of descent 29 of the outer-case locking means 26.

Below a height position of the inner-case locking means 25, a stopper 30 is formed by cutting, with an upper end edge of the stopper 30 being a cutting line that is part of the cut that forms the opening portion around the lid-raising means 23.

Then, the cutting line, which is the upper end edge of the stopper 30, is arranged at the lowest position of descent 29 with respect to the inner case 3. More specifically, the stopper 30 that has the lowest position of descent 29 as the upper end edge thereof is provided in the rear-side plate 15 of the inner case 3. Further, in the present embodiment, the lid-raising means 23 includes guiding means 31 so that the outer-case locking means 26, which moves downward toward the lowest position of descent 29, is in contact against the stopper 30.

(Guiding Means)

As shown in FIG. 2, the guiding means 31 according to the first embodiment is integrally provided in a side portion of the inner-case locking means 25 of the lid-raising means 23, and the guiding means 31 is formed by a convex piece that extends sideways in one of side end portions of the inner-case locking means 25. Then, the guiding means 31 extends so as to be positioned in a portion across from a position of a vertical cut edge provided on one side of the lid-raising means 23 to an inner surface side of the rear-side plate 15 of the inner case 3, the vertical cut edge being one of cuts that form the opening around a lower portion of the lid-raising means 23. The guiding means 31 is locked to the inner surface of the rear-side plate 15 of the inner case 3 while being slidably in contact with the inner surface.

The guiding means 31 is locked to the portion across from the vertical cut edge to the inner surface of the rear-side plate 15 while being slidably in contact with the portion. The guiding means 31 is locked to the rear-side plate 15 in any state in which the lid-raising means 23 moves upward and downward. In an example shown in the figures, a recess having an approximate V shape is formed at a lower portion of the vertical cut edge. The recess is a portion that is generated when the guiding means 31 integrally provided with the inner-case locking means 25 is formed by cutting. The recess is provided so that the guiding means 31 does not reach the recess even when the lid-raising means 23 moves upward and downward in a state in which the guiding means 31 is locked.

As described above, the guiding means 31 is locked to the inner surface of the rear-side plate 15 along an opening edge of the opening portion on one side of the guiding means 31 while being able to move in sliding contact with the inner surface. At least a side on which the guiding means 31 of the inner-case locking means 25 is positioned is positioned on an inner side of the inner case 3. Further, the inner-case locking means 25 itself is formed by being folded upward on a side of the rear-side plate 7 of the outer case 2. The inner-case locking means 25 is not in a state of being tightly in close contact with the leg-like portions 28, but instead, the inner-case locking means 25 enters a state in which an upper side thereof is open in an approximate V shape in a vertical cross section due to restoring force of the packaging container itself (refer to FIG. 6 to FIG. 8).

In this manner, as the guiding means 31, which is provided on one of the side portions of the inner-case locking means 25 opened due to slight unfolding, is locked to the rear-side plate 15 on a side of the lid-raising means 23, a state is obtained in which the guiding means 31 slightly presses the rear-side plate 15 from the inner side of the inner case. Also, from this point, the guiding means 31 side of the inner-case locking means 25 is caused to be positioned on the inner side of the inner case 3. Therefore, when viewed from an upper side of the container, an end portion on the guiding means 31 side of the inner-case locking means 25 is positioned on the inner side of the inner case, and other portions of the inner-case locking means 25 (portions other than the guiding means side) are arranged so as to diagonally traverse above the stopper 30. Note that, even when the opening around the lid-raising means 23 is covered by a backing plate, which will be described below, from the inner side of the inner case, the guiding means 31 is locked to the rear-side plate 15 and is arranged so as to intersect with the inner-case locking means 25 on an incision edge of the stopper 30 (FIG. 6 to FIG. 8).

(Outer-Case Locking Means and Stopper)

When the inner case 3 is not moved upward above the outer case 2, the opening and closing lid 12 is positioned at the insertion and removal opening 4 of the outer case 2 and is closed. Then, as described above, the inner-case locking means 25 and the outer-case locking means 26 are separated vertically and are in a state of not engaging with each other (FIG. 6). As described above, the inner-case locking means 25 is slightly open and the central convex portion thereof is slidably in contact with the inner surface of the rear-side plate 7 of the outer case 2.

As a result of an unfolding effect in part of the upper end portion of the rear-side plate 7, the outer-case locking means 26 is also in a state of being pressed against to open toward the rear-side plate 15 of the inner case 3. The outer-case locking means 26 is provided so as to slightly open even when the inner case 3 is set. In addition, a central portion of a lower portion of the outer-case locking means 26 is positioned in an opening portion between the leg-like portions 28 in the lid-raising means 23, and the central portion of the lower portion is provided so as to be easily biased toward the inner side of the inner case even slightly.

As described above, the inner-case locking means 25 of the lid-raising means 23 being formed by being folded back is slightly open upward on a side of the outer case 2, and the outer-case locking means 26 is slightly open downward on a side of the inner case 3, the outer-case locking means 26 being formed by the tongue piece that is folded downward. Accordingly, by moving the inner case 3 upward, central portions of both of the locking means mutually enter inside the opposing locking means (FIG. 7).

Further, the guiding means 31, which is provided in the lid-raising means 23, is positioned on the inner surface side of the rear-side plate 15 of the inner case 3, and a cut portion 32 is provided in the outer-case locking means 26 to cause the outer-case locking means 26, which moves downward in a relative manner on an outer surface side of the rear-side plate 15 of the inner case 3, to enter inside the inner-case locking means 25. Here, the cut portion 32 is open downward corresponding to a portion in which the guiding means 31 enters inside the inner case 3.

Then, as the inner case 3 moves upward, the inner-case locking means 25 and the outer-case locking means 26 face each other, and the outer-case locking means 26 engages with the inner-case locking means 25 while a portion on the guiding means 31 side of the inner-case locking means 25 enters into the cut portion 32 while the portion on the guiding means 31 side of the inner-case locking means 25 intersects with the cut portion 32 (FIG. 8).

As described above, a slight force pressing the outer-case locking means 26 in the direction of opening toward the side of the inner case 3 is generated in the outer-case locking means 26. As shown in the figures, as the central portion of the lower portion of the outer-case locking means 26 corresponds to a central portion of the inner-case locking means 25, the portion of the outer-case locking means 26 corresponding to the inner-case locking means 25 is in a state of slightly moving toward the inner side of the inner case 3 together with the inner-case locking means 25. In addition, as a state is obtained in which the guiding means 31 causes part of the inner-case locking means 25 to be positioned closer to the inner side of the inner case 3 in advance and the outer-case locking means 26 is guided toward a side of the stopper 30, the central portion of the lower portion of the outer-case locking means 26 moves in a state of being securely positioned closer to the inner side of the inner case, even though the amount of movement toward the inner side of the inner case 3 is very small.

When the inner case 3 is moved upward further, the lid-raising means 23 (the inner-case locking means 25) and the outer-case locking means 26 move downward relative to the rear-side plate 15 of the inner case 3, and the opening and closing lid 12 starts rotating in the opening direction. Then, the inner-case locking means 25 and the outer-case locking means 26 move downward and approach a height position of the stopper 30. The outer-case locking means 26 has the same width as that of the rear-side plate 7 of the outer case 2, and the width of the outer-case locking means 26 is wider than that of the stopper 30. A stopper-corresponding portion 33 of the outer-case locking means 26 is locked to the inner-case locking means 25. As a result of the above-described slight opening of the outer-case locking means 26 itself and an operation of the guiding means 31, the inner-case locking means 25 approaches the stopper 30 in a state in which the inner-case locking means 25 is arranged so as to intersect with the stopper 30 or is positioned on the inner side of the inner case 3. Further, part of the stopper-corresponding portion 33 of the outer-case locking means 26 also approaches the stopper 30 while being arranged so as to intersect with the incision edge that forms the stopper 30 (FIG. 9).

When the stopper-corresponding portion 33 of the outer-case locking means 26, which moves downward relative to the rear-side plate 15 (the inner case 3) as the inner case 3 moves upward, is in contact against the incision edge being the stopper 30, the downward movement of the outer-case locking means 26 is stopped (FIG. 10). More specifically, the upward movement of the inner case 3 is regulated and stopped, and it becomes impossible to cause the inner case 3 to move upward even when the slide-up operation is performed through the slide operation opening 10. At this point, the opening and closing lid 12 is in a state of being fully open without covering the upper side of the removal opening 11 of the inner case 3, and the opening and closing lid 12 also stops rotating in the opening direction.

The stopper 30 is part of the cuts for forming the opening around the lid-raising means 23 and enabling the lid-raising means 23 to move upward and downward on its own with respect to the rear-side plate 15. As described above, as the stopper 30 is formed by having the incision edge arranged at the lowest position of descent of the outer-case locking means 26 as an upper end portion thereof, the structure of the stopper itself is extremely simple and thus the stopper is formed easily. Then, a structure is provided in which the stopper 30 is obtained simply by forming the incision edge, with the stopper 30 serving an important role of stopping the relative downward movement of the outer-case locking means 26 and regulating the inner case 3 not to move upward unnecessarily. Thus, it is possible to inhibit an unnecessary slide-up operation of the inner case 3 from causing damage around the upper portion of the lid-raising means or around the first hinge without using separate members, etc., the damage being described above in relation to a conventional product.

In the above-described embodiment, the above-described backing plate 34 is arranged on the inner surface side of the rear-side plate 15 of the inner case 3 (FIG. 3). The backing plate 34 covers the lid-raising means 23 and an opening that is formed by cutting a portion around the lid-raising means 23. The backing plate 34 improves an aesthetic aspect inside the packaging container by concealing the lid-raising means 23, the inner-case locking means 25, etc. and is also devised to stop the stored object from interfering with the lid-raising means 23, the outer-case locking means 26, etc. Note that, in FIG. 6 to FIG. 8, the backing plate 34 is not shown in the figures in order to make it easy to describe the engagement between the inner-case locking means 25 in the lid-raising means 23 and the outer-case locking means 26 and movements thereof.

Further, the backing plate 34 inhibits the inner-case locking means 25 from entering by a significant amount inside the inner case 3. The lid-raising means 23 is slidably in contact with an outer surface of the backing plate 34 when the inner case 3 moves upward and downward. Then, in order to maintain a state in which the backing plate 34 is in contact with the inner surface of the rear-side plate 15 of the inner case 3, sleeve plates 35 are connected to both sides of the backing plate 34. The sleeve plates 35 have a protruding length corresponding to a width of the left-side and right-side plates 14 and 16 of the inner case 3. The sleeve plates 35 are in contact against the front-side plate 13 along inner surfaces of the left-side and right-side plates 14 and 16 and cause the backing plate 34 to be in contact with the inner surface side of the rear-side plate 15.

Note that, a pressing force generated as a result of the outer-case locking means 26 opening toward the inner case 3 is not large, the pressing force pressing the lid-raising means 23, the inner-case locking means 25, etc. toward the inner side of the inner case. Accordingly, the stopper-corresponding portion 33 does not move so as to enter inside the inner case by a significant amount together with the inner-case locking means 25. Therefore, it is not necessarily necessary to use the backing plate 34 for the purpose of regulating the entry of the outer-case locking means 26, the lid-raising means 23, etc. Instead, the interference between the inner-case locking means, the outer-case locking means, etc. and the stored object may be inhibited by using a packaging paper that directly packages the stored object.

In the packaging container 1, as described above, it is possible to remove the stored object from the removal opening 11 of the inner case 3 by making the inner case 3 move upward to open the opening and closing lid 12. Then, to move the ascended inner case 3 downward, it is only necessary to perform an operation of sliding down the front-side plate 13 of the inner case 3 through the slide operation opening 10. At that time, first, the inner case body portion moves downward in a state in which the lid-raising means 23 (the inner-case locking means 25) and the outer-case locking means 26 engage with each other, and as a result, as a position of the first hinge 22 is lowered, the opening and closing lid 12 rotates in the closing direction. Then, an upper portion of the lid-raising means 23 (between the second hinge 24 and the third hinge 27) is raised while being guided by the rotation of the opening and closing lid 12 and the upper end portion of the rear-side plate 7 of the outer case 2. Furthermore, as a result of the inner case 3 moving downward, the engagement between the inner-case locking means 25 and the outer-case locking means 26 is released. Then, the bottom-surface plate 17 of the inner case 3 and the bottom-surface plate 9 of the outer case 2 come into contact with each other so as to stop the downward movement of the inner case 3. Thus, the opening and closing lid 12 is positioned in the insertion and removal opening 4 of the outer case 2 in a closed state.

In this manner, the opening and closing lid 12 is opened and closed by moving the inner case 3 upward and downward, and even at a time when the inner case 3 is moving upward, the inner case 3 itself stops the unnecessary slide-up operation to the inner case 3. Therefore, it is possible to obtain a good packaging container that inhibits any ripping, etc. from being generated around the first hinge or on a side of the upper portion of the lid-raising means in the opening and closing lid 12.

As described above, the packaging container 1 is the packaging container made from paper that stores a cigarette tobacco. The packaging container 1 is devised to inhibit the waste leaf tobacco from leaking out of a portion between a free end of the opening and closing lid 12 and an upper end portion of the front-side plate 5 of the outer case 2 corresponding to the free end.

In terms of the prevention of leakage of the waste leaf tobacco, a first tongue piece 36 is connected across the upper end portion of the front-side plate 5 of the outer case 2 so that the first tongue piece 36 can be folded toward the inner side of the inner case 3. Furthermore, a slide plate 38 is connected thereto via leg-like pieces 37 that are arranged on both sides on a free end side of the first tongue piece 36 (refer to FIG. 1 and FIG. 11). Then, the slide plate 38 can move upward and downward along the inner surface of the front-side plate 5. The slide plate 38 enables the first tongue piece 36 to rotate in a range from a bent down state to a raised state thereof while accompanying bending and opening of hinge portions provided in upper and lower portions of each of the leg-like pieces 37 and bending and opening of folding portions provided in a base end of the first tongue piece 36 (Refer to FIG. 6 to FIG. 8).

Then, the first tongue piece 36 for preventing the leakage of the waste leaf tobacco moves in conjunction with the upward and downward movements of the inner case 3. When the inner case 3 moves upward, an upper end portion of the front-side plate 13 of the inner case 3 pushes up portions of the leg-like pieces 37 from below, and as a result, the first tongue piece 36 stands up so as not to interfere with the upward movement of the inner case 3. Further, when the inner case 3 moves downward, a locking convex piece 39 is locked to an end portion of the slide plate 38 and causes the slide plate 38 to move downward, where the locking convex piece 39 is provided in the upper end portion of the front-side plate 13 of the inner case 3 and having the convex shape toward the front-side plate 5 of the outer case 2. When the slide plate 38 is pulled downward, the first tongue piece 36 rotates so as to be bent down sideways. The locking convex piece 39 is provided so as to overlap with the free end of the opening and closing lid 12 at that time (FIG. 1, FIG. 6).

(Outer Case Blank)

Figure 11:
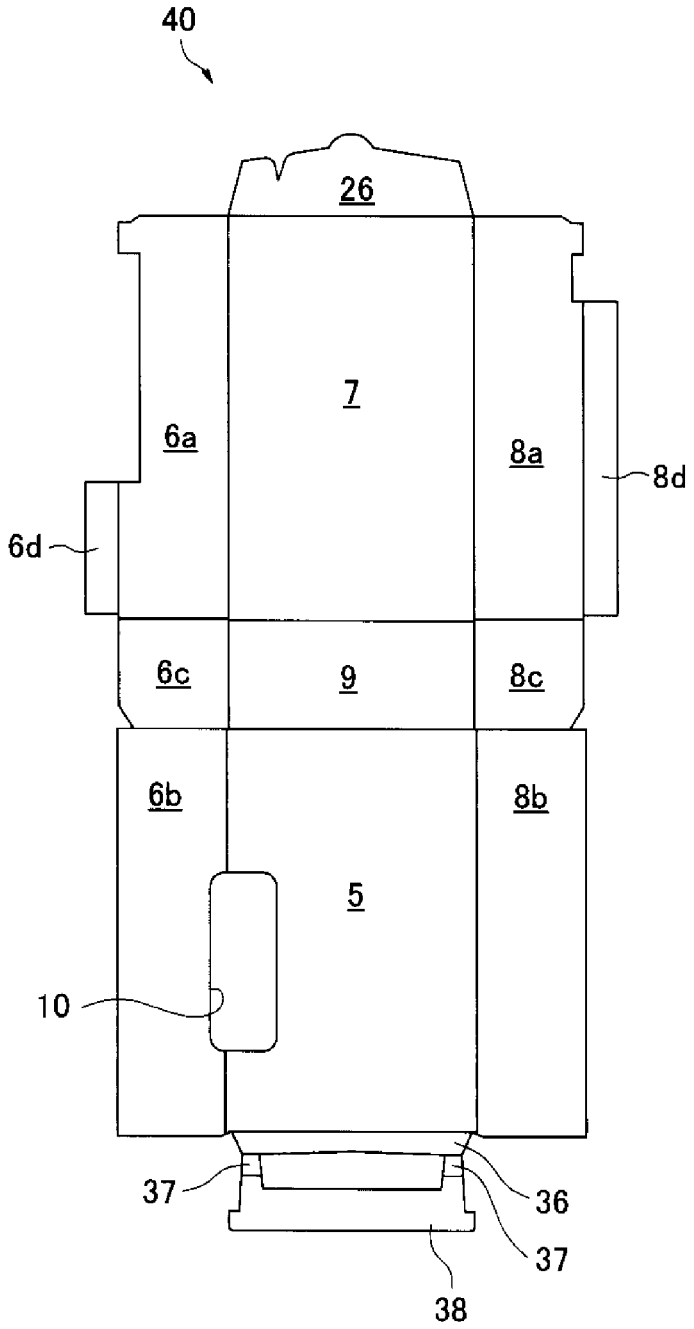
FIG. 11 is an illustrative diagram showing a blank of the outer case in the first embodiment.
Figure 12:
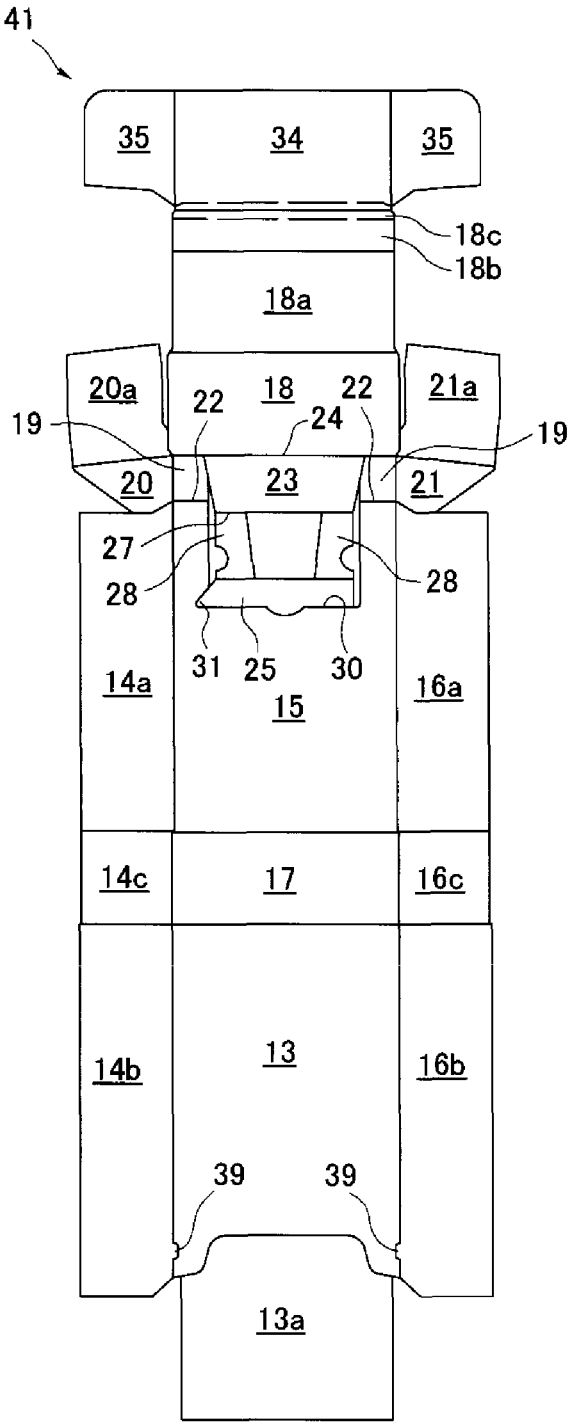
FIG. 12 is an illustrative diagram showing a blank of the inner case in the first embodiment.

FIG. 11 and FIG. 12 show blanks of the outer case 2 and the inner case 3 of the packaging container 1, and each of the blanks is illustrated so that a surface forming an outer side of each of the cases can be viewed. As shown in FIG. 11, in the outer case 2, the front-side plate 5, the bottom-surface plate 9, and the rear-side plate 7 are connected with each other. A right-side plate panel 6*a* for obtaining the right-side plate 6 and a left-side plate panel 8*a* for obtaining the left-side plate 8 are connected to the rear-side plate 7, and a right-side plate panel 6*b* for obtaining the right-side plate 6 and a left-side plate panel 8*b* for obtaining the left-side plate 8 are connected to the front-side plate 5. Then, while flaps 6*c* and 8*c*, which are connected to the right-side plate panel 6*a* and the left-side plate panel 8*a*, are overlapped with the bottom-surface plate 9, the right-side plate panel 6*b* is overlapped with an outer surface side of the left-side plate panel 8*a* and the left-side plate panel 8*b* is overlapped with an outer surface side of the left-side plate panel 8*a*. A basic part of the outer case 2 is formed by pasting together respective bonded surfaces between the required plates, wherein the front-side plate 5 and the rear-side plate 7 face each other and the outer case 2 is in rectangular parallelpiped shape with the upper portion thereof open.

As shown by a blank 40, backing panels 6*d* and 8*d*, which are in contact with the inner surface of the front-side plate 5, are connected to the right-side plate panel 6*a* and the left-side plate panel 8*a*. In the front-side plate 5, the slide operation opening 10 is opened across the right-side plate panel 6*b*. The first tongue piece 36 for preventing the leakage of the tobacco leaves is connected to the upper end portion of the front-side plate 5 on a side of the insertion and removal opening 4, and as described above, the slide plate 38 is connected to the first tongue piece 36 via the leg-like pieces 37. Further, as described above, the outer-case locking means 26 is connected to the upper end portion of the rear-side plate 7 on the side of the insertion and removal opening 4.

Of the right-side plate panel 6*a* and the left-side plate panel 8*a* that are provided on both sides of the rear-side plate 7, in the right-side plate panel 6*a*, a portion corresponding to the slide operation opening 10 is cut out, and the backing panel 6*d* is also shortened in the same manner.

(Inner Case Blank)

As shown by a blank 41 of FIG. 12, in the inner case 3, the front-side plate 13, the bottom-surface plate 17, and the rear-side plate 15 are connected with each other, a left-side plate panel 16*a* for obtaining the left-side plate 16 and a right-side plate panel 14*a* for obtaining the right-side plate 14 are connected to the rear-side plate 15, and a left-side plate panel 16*b* for obtaining the left-side plate 16, a right-side panel 14*b* for obtaining the right-side plate 14, and a backing panel 13*a* for reinforcing the front-side plate 13 from the inner surface side of the inner case 3 are connected to the front-side plate 13. Then, while flaps 16*c* and 14*c*, which are connected to the left-side plate panel 16*b* and the right-side plate panel 14*b*, are overlapped with the bottom-surface plate 17, the left-side plate panel 16*b* is overlapped with an outer surface side of the left-side plate panel 16*a* and the right-side plate panel 14*b* is overlapped with an outer surface side of the right-side plate panel 14*a*. A basic part of the inner case 3 is formed by pasting together respective bonded surfaces between the required plates, wherein the front-side plate 13 and the rear-side plate 15 face each other and the inner case 3 is a rectangular parallelepiped shape. The backing panel 13*a* is folded back and overlapped with the inner surface of the front-side plate 13.

As described above, the inner case 3 has the opening and closing lid 12. In the opening and closing lid 12, the top-surface plate 18 is connected to the rear-side plate 15 via a pair of the rear-side plates 19 that are separated from each other in the width direction of the top-surface plate 18, and the lid-raising means 23 is formed by cutting a portion across from a rear side portion of the top-surface plate 18 to the rear-side plate 15. Note that, as the inner case 3 is illustrated in a state of a blank, the portion that is to be the inner-case locking means 25 in a fully-assembled inner case 3 is shown in a state before being folded back.

As other plate panels that form the opening and closing lid 12, a lower backing panel 18*a* is connected to a front edge side of the top-surface plate 18, the left-side and right-side plates 20 and 21 are connected to the rear-side plate 19, and flaps 21*a* and 20*a* that are arranged between the top-surface plate 18 and the lower backing panel 18*a* are connected to the left-side plate 21 and the right-side plate 20, respectively. As shown in the figures, a connection panel 18*b* corresponding to a rear surface side of the opening and closing lid 12 (the upper portions of the rear-side plate 19 and the lid-raising means 23) is connected to the lower backing panel 18*a*. Further, the backing plate 34 is connected to the connection panel 18*b* via a hinge 18*c*, which has many slits inserted therein so as to permit bending accompanying stretching. Furthermore, the sleeve plates 35 are connected to both sides of the backing plate 34 (Refer to FIG. 3).

Also, in the opening and closing lid 12, the flaps 20*a* and 21*a* are folded and assembled so as to be positioned between the top-surface plate 18 and the lower backing panel 18*a*, and further, the connection panel 18*b* is arranged on the rear surface of the opening and closing lid 12. Then, the inner case 3 is folded and assembled by arranging the backing plate 34 so that the backing plate 34 covers the above-described lid-raising means 23 in the rear-side plate 15 of the inner case 3.

(Second Embodiment)

Although the guiding means 31 is integrally provided on one of the end portions of the inner-case locking means 25 in the above-described first embodiment, the present invention is not limited to this example. The present invention can be provided as in a second embodiment shown in FIG. 13 to FIG. 15. In the same manner as in the first embodiment, in the second embodiment, the inner-case locking means 25 and the outer-case locking means 26 engage with each other, and the opening and closing lid 12 rotates in the opening direction by moving the inner case 3 upward. Then, in the second embodiment, a position in which the guiding means 31 is provided is different from that of the first embodiment, and according to the arrangement of the guiding means 31, a shape of the outer-case locking means 26 is also different from that of the first embodiment. Other points except for the above-described points are the same as the first embodiment, and descriptions for portions having the same structure are omitted herein.

(Guiding Means)

Figure 13:
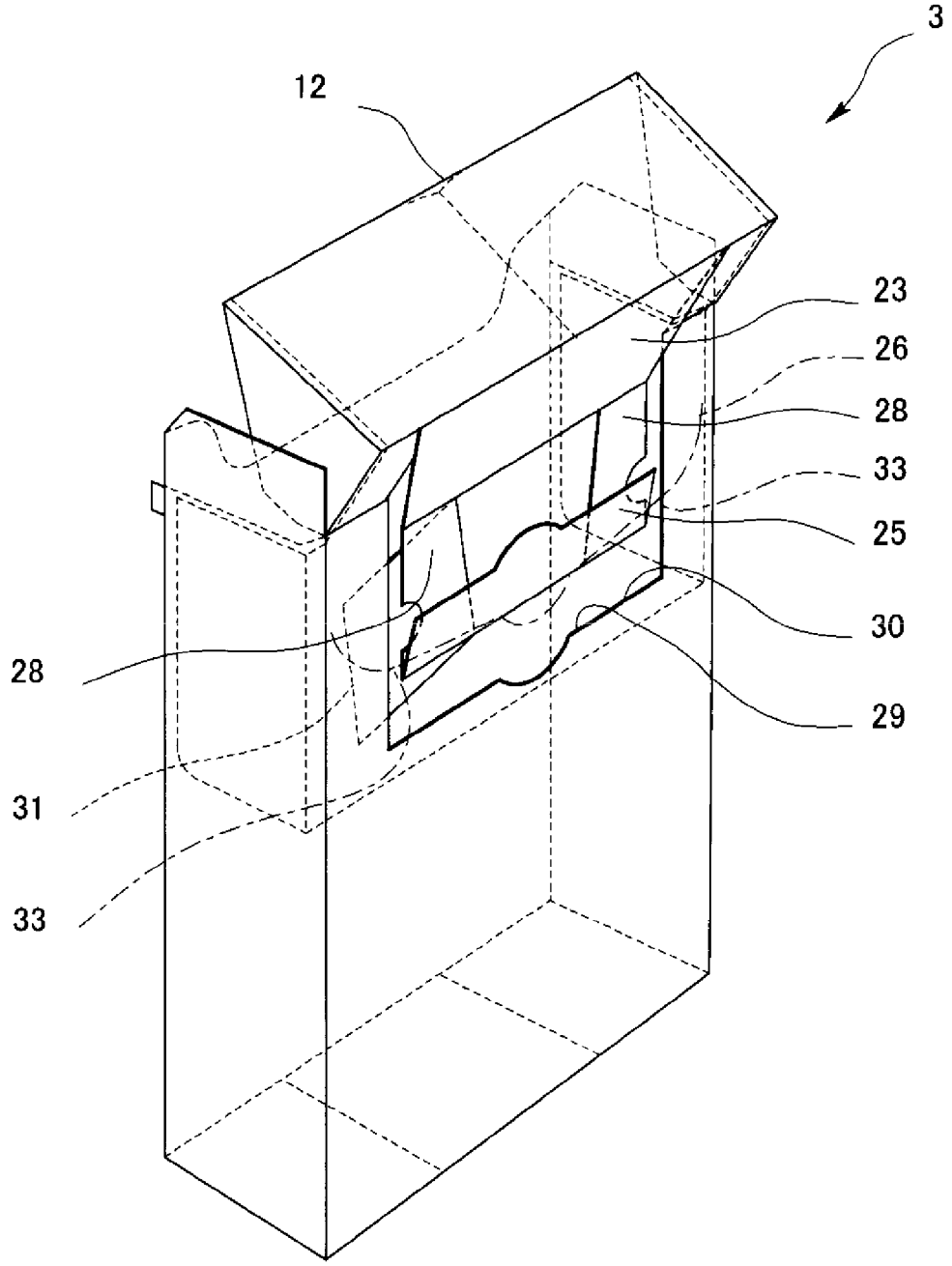
FIG. 13 is an illustrative diagram showing the lid-raising means and the guiding means in a second embodiment.

As shown in FIG. 13, the guiding means 31 according to the second embodiment is formed by a plate piece that is connected to an inner end edge of one of the pair of leg-like portions 28 in the lid-raising means 23 and is folded back toward the inner side of the inner case 3. Then, the guiding means 31 has a length that allows a tip end portion of the folded-back plate piece to pass the position of the vertical cut edge provided on the side of the lid-raising means 23 and to be slidably in contact with the inner surface of the rear-side plate 15 of the inner case 3. Further, in forming the guiding means 31, a portion between the pair of the leg-like portions 28 is cut continuously in an approximate laterally-directed U-shape, having the inner end edge of the one of the leg-like portions 28 as a folding portion. The guiding means 31 is formed by folding back the cut plate piece toward the inner surface of the rear-side plate 15 as described above.

When the inner-case locking means 25 moves downward relative to the rear-side plate 15, the guiding means 31, which is continuous to the inner end edge of the leg-like portions 28 and is slidably in contact with the inner surface of the rear-side plate 15, guides the inner-case locking means 25 to move downward toward the stopper 30. Thus, the inner-case locking means 25 does not move downward on an outer surface side of the rear-side plate 15. More specifically, as the inner-case locking means 25 is guided to move downward toward the stopper 30, the stopper-corresponding portion 33 of the outer-case locking means 26, which is locked so that a lower end portion thereof enters inside the inner-case locking means 25, is also guided by the guiding means 31 to move downward toward the stopper 30.

During the downward movement of the inner-case locking means 25 by the slide-up operation of the inner case 3, due to the momentum of the lid-raising means 23 moving downward, due to the guiding means 31 being in sliding contact with the inner surface of the rear-side plate 15, and further, due to the folded-back central portion of the inner-case locking means 25 being also in a state of being pressed against to be in sliding contact with the inner surface of the rear-side plate 7 of the outer case 2, the inner-case locking means 25 is in a state of being slightly moved toward the inner side of the inner case with respect to the rear-side plate 15 when the lower edge of the inner-case locking means 25 reaches the stopper 30. Then, the stopper-corresponding portion 33 of the outer-case locking means 26, which is locked to the inner-case locking means 25, is in contact against the stopper 30, and the upward movement of the inner case 3 is regulated by the contact even when the slide-up operation is performed.

As described above, in the above-described first embodiment, the guiding means 31 has a form in which one of the end portions of the outwardly folded inner-case locking means 25 is extended and the extended convex piece is arranged on the inner surface side of the rear-side plate 15 of the inner case 3. Therefore, in the outer-case locking means 26 that engages with the inner-case locking means 25, the cut portion 32 is provided so as to step over the extended portion. On the other hand, in the second embodiment, as the guiding means 31 is folded back toward the inner side of the inner case from the leg-like portion 28 as described above, the outer-case locking means 26 does not intersect with the guiding means 31. Therefore, no cut portion is provided therein.

(Blanks of Second Embodiment)

Figure 14:
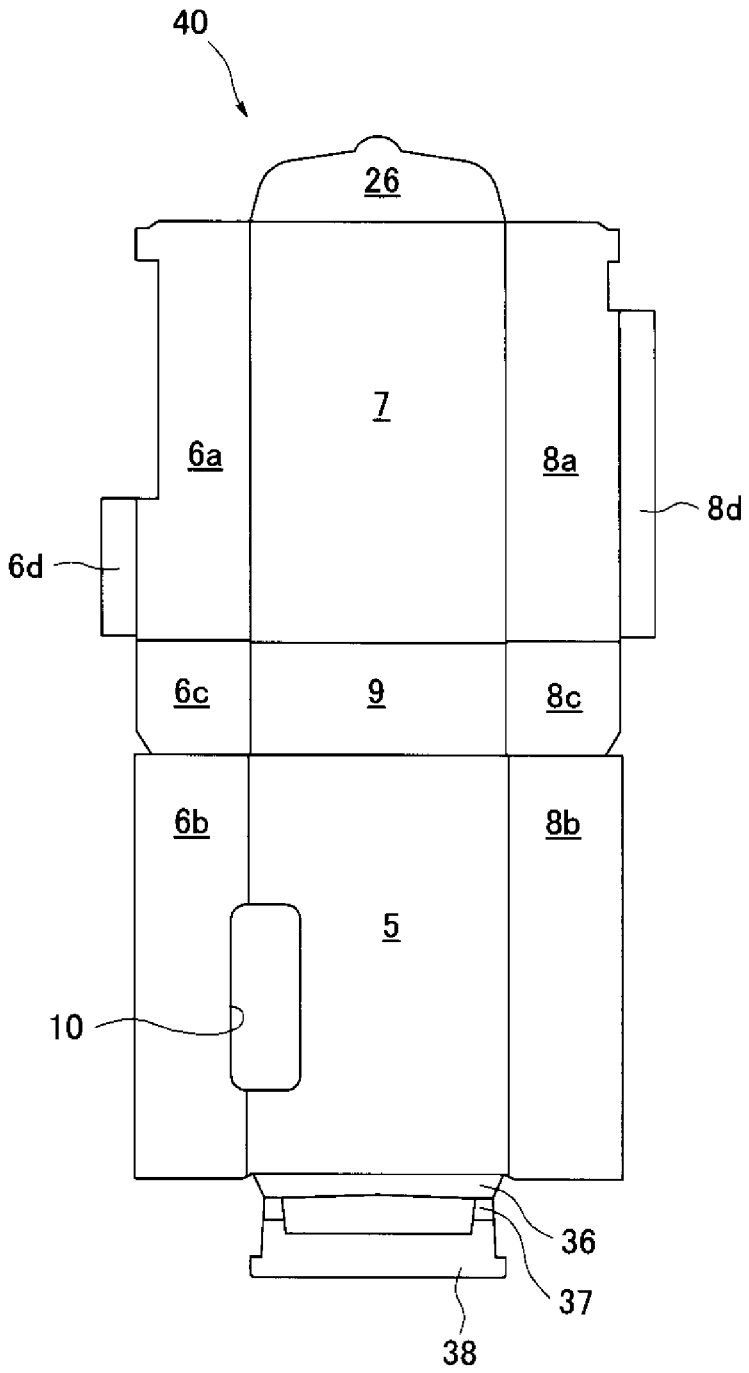
FIG. 14 is an illustrative diagram showing the blank of the outer case in the second embodiment.
Figure 15:
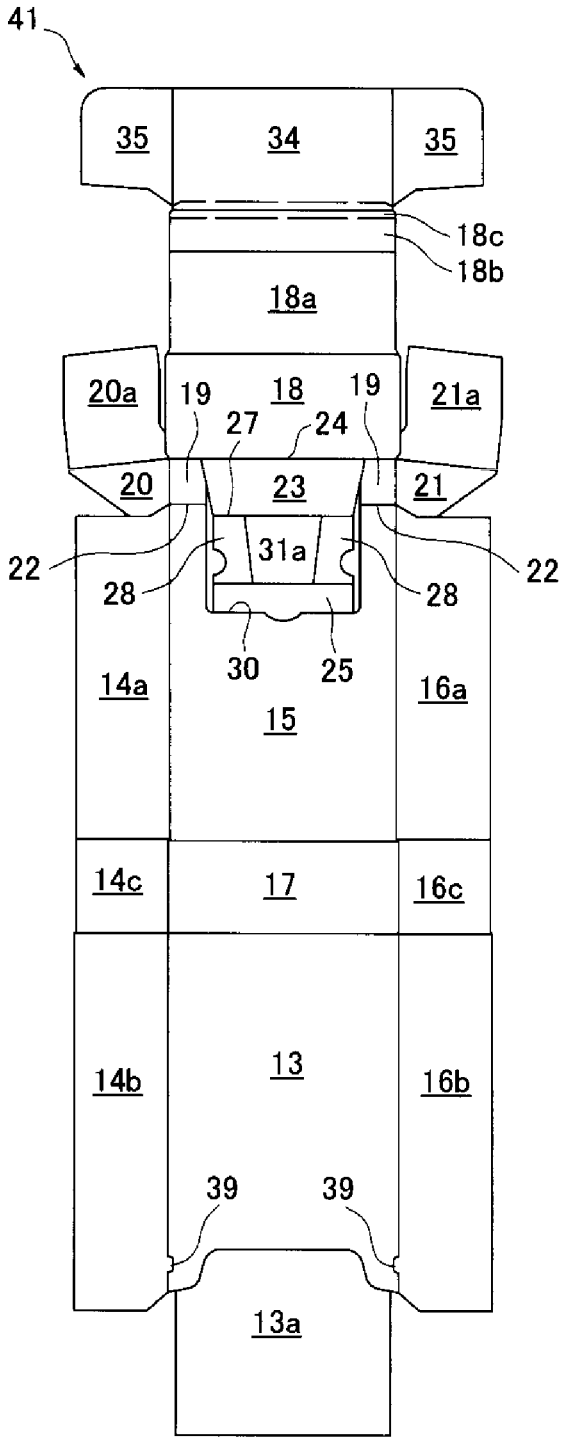
FIG. 15 is an illustrative diagram showing the blank of the inner case in the second embodiment.

FIG. 14 and FIG. 15 show the blanks 40 and 41 for obtaining the outer case 2 and the inner case 3 of the packaging container 1 according to the second embodiment. With respect to the blanks 40 and 41, again, descriptions for portions having the same structure as the first embodiment are omitted herein. More specifically, a structure for obtaining the guiding means 31 is different from that of the first embodiment. In the second embodiment, a guiding means panel 31*a* is formed by cutting a portion between the leg-like portions 28 into an approximate laterally-directed U-shape as described above, and the guiding means panel 31*a* is folded back when the cases are folded and assembled. A method for obtaining the inner-case locking means 25 is also the same as that of the first embodiment, in which the part that forms the inner-case locking means 25 is cut at the same time when the lid-raising means 23 is formed by cutting, and the part plays a role as a lock after being folded back. Then, also with respect to the outer-case locking means 26 in the outer case 2, no cut portion is required.

(Third Embodiment)

Figure 16:
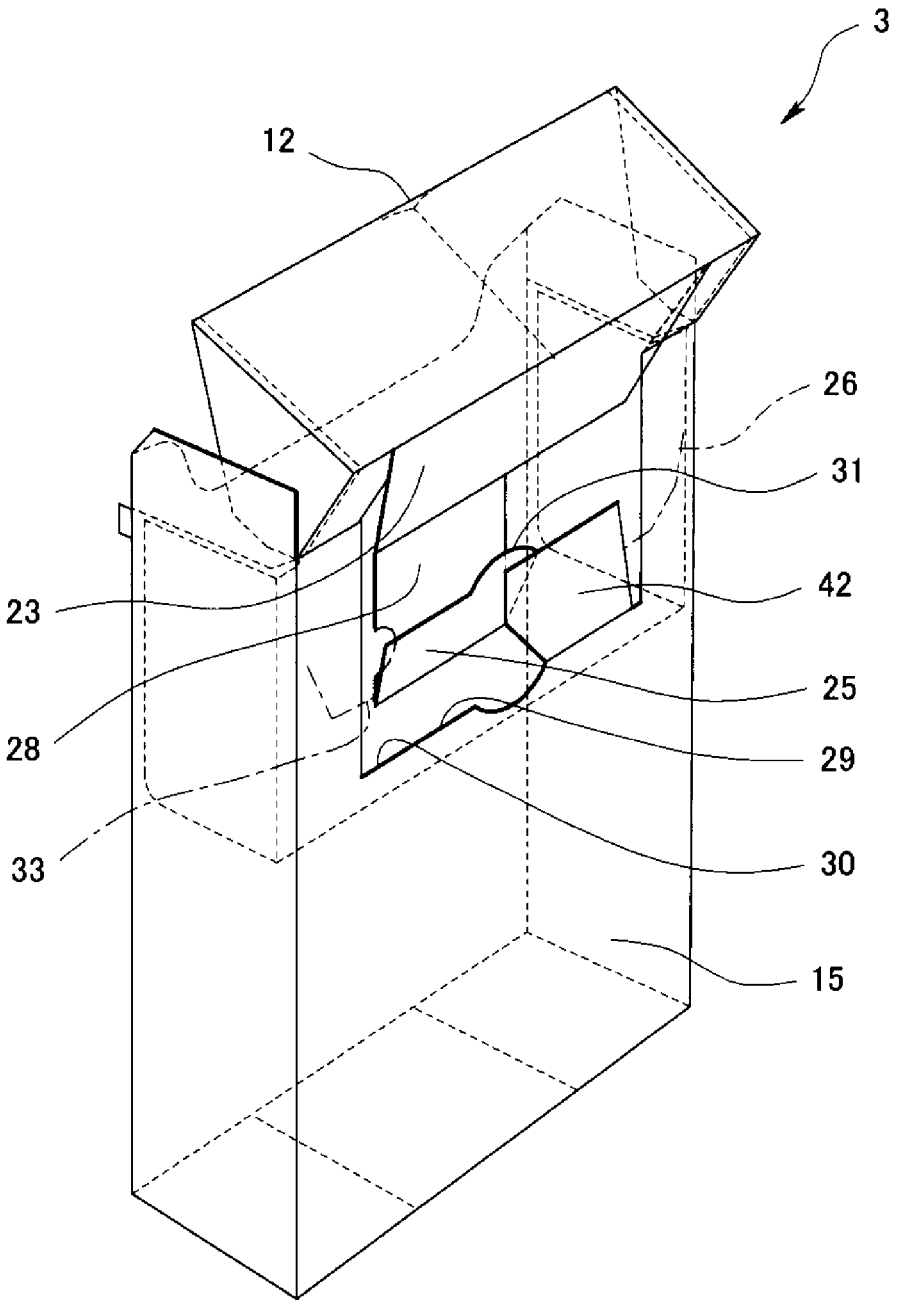
FIG. 16 is an illustrative diagram showing the lid-raising means and the guiding means in a third embodiment.
Figure 17:
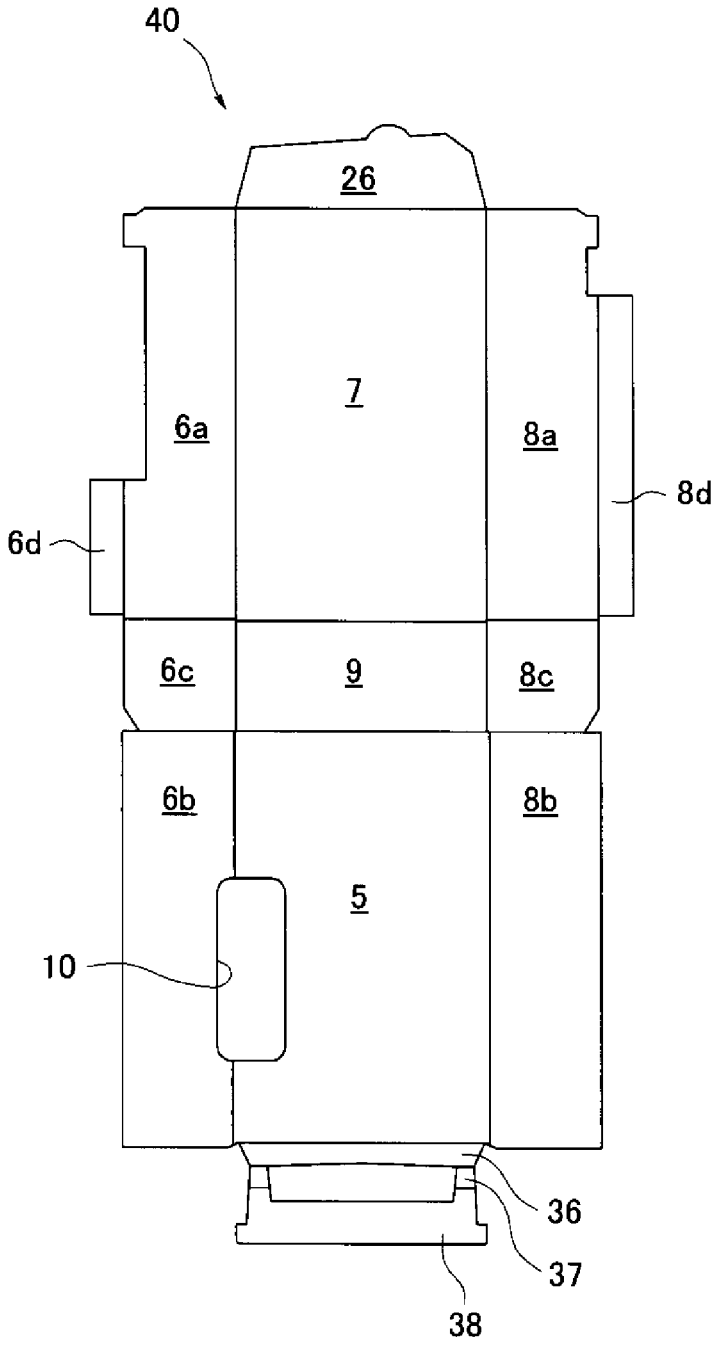
FIG. 17 is an illustrative diagram showing the blank of the outer case in the third embodiment.
Figure 18:
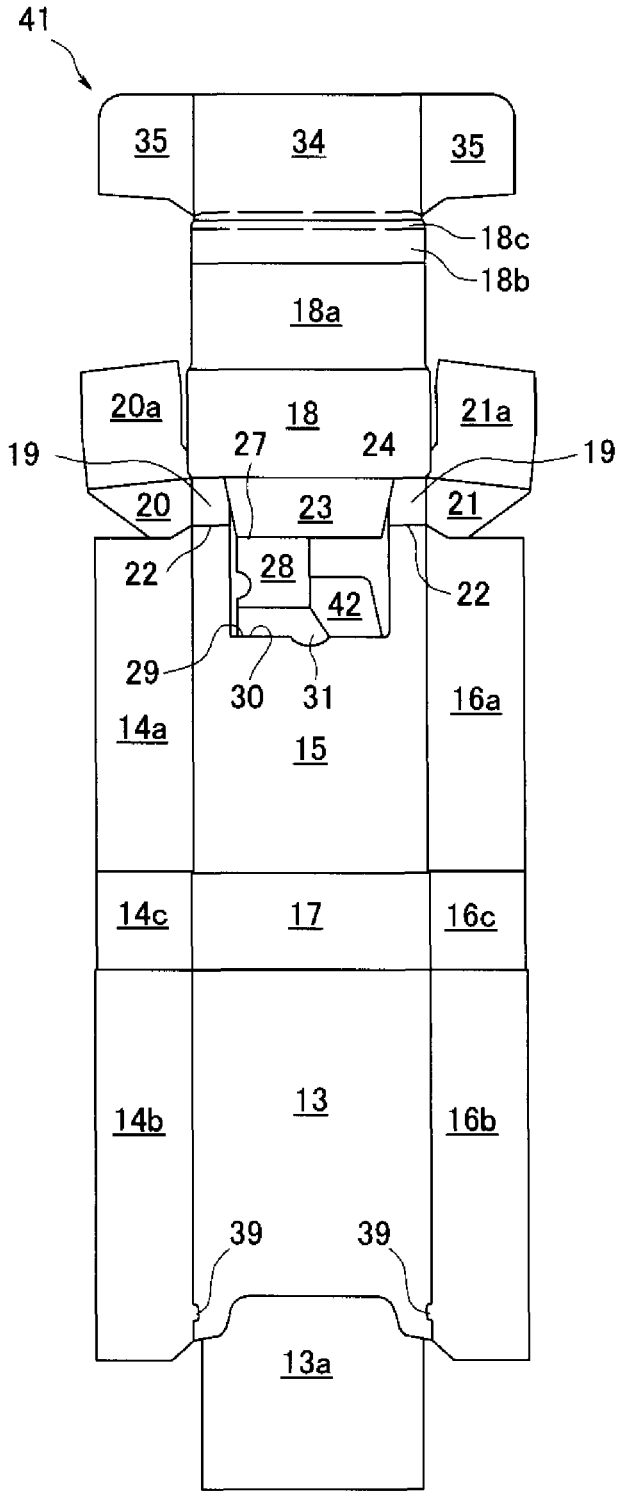
FIG. 18 is an illustrative diagram showing the blank of the inner case in the third embodiment.

FIG. 16 to FIG. 18 show a third embodiment of the present invention. In this example, a single leg-like portion 28 is provided in the lid-raising means 23, and the folded-back inner-case locking means 25 is formed in the leg-like portion 28. Then, the inner-case locking means 25 has a length that positions a right-side portion thereof roughly on the central line of the rear-side plate 15, and the guiding means 31, which is formed by a convex piece, is provided on a side of the right-side portion. As shown in the figures, the guiding means 31 is slidably in contact with a tongue-shaped receiving plate 42, which is extended upward from the rear-side plate 15 having a base end thereof at the height position of the stopper 30, and the guiding means 31 is overlapped with an inner surface of the receiving plate 42 on the inner side of the inner case thereof. More specifically, similarly to the guiding means 31 according to the first and second embodiments, the guiding means 31 according to the third embodiment is also overlapped with the inner surface side of the inner case 3 while being slidably in contact therewith, and the guiding means 31 guides the descending inner-case locking means 25 to move downward toward the incision edge of the stopper 30.

In the third embodiment, as the guiding means 31 that is connected to the folded-back inner-case locking means 25 is overlapped with the tongue-shaped receiving plate 42, the receiving plate 42 is slightly inclined toward the inner surface (the rear-side plate 7) of the outer case 2. Then, when the outer-case locking means 26 that engages with the inner-case locking means 25 moves downward toward the stopper 30, the stopper-corresponding portion 33 is positioned on the receiving plate 42 on the inner side of the inner case 3 thereof. Further, the inner-case locking means 25 is in contact against the stopper 30 and the stopper-corresponding portion 33 is in contact against the stopper 30 while the inner-case locking means 25 moves slightly toward the inner side of the inner case 3 from the position of the stopper. As a result, the upward movement of the inner case 3 is regulated in the same manner as in the above-described embodiments. In the third embodiment, an incision edge in a side portion (on the right-side plate side) of the receiving plate 42 is also formed as part of the stopper 30.

(Blanks of Third Embodiment)

FIG. 17 and FIG. 18 show the blanks 40 and 41 of the outer case 2 and the inner case 3 according to the third embodiment. Describing different constituent portions of the blanks from those of other embodiments in terms of obtaining the packaging container 1, the part that forms the inner-case locking means 25 has roughly half the length of that of the inner-case locking means 25 in the above-described embodiments, and the part is connected to the single leg-like portion 28. Then, a convex piece is extended on one of the side portions of the inner-case locking means 25 so as to form the guiding means 31. Further, the receiving plate 42 is formed by cutting so as to be adjacent to the leg-like portion 28 and the inner-case locking means 25. To obtain the inner-case locking means 25 that has a locking function, the part forming the inner-case locking means 25 is folded back so as to position the guiding means 31 on an inner surface side of the receiving plate 42.

(Fourth Embodiment)

Figure 19:
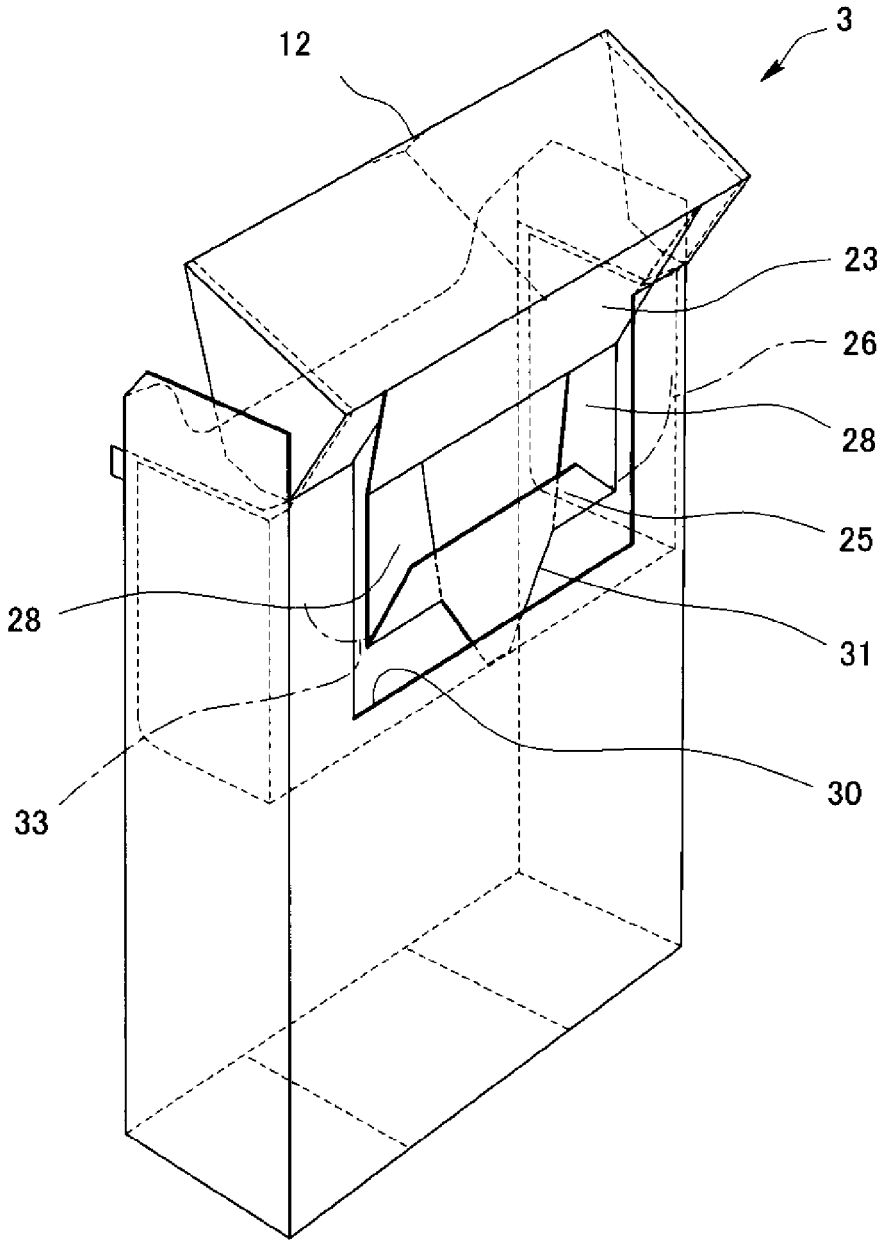
FIG. 19 is an illustrative diagram showing the lid-raising means and the guiding means in a fourth embodiment.
Figure 20:
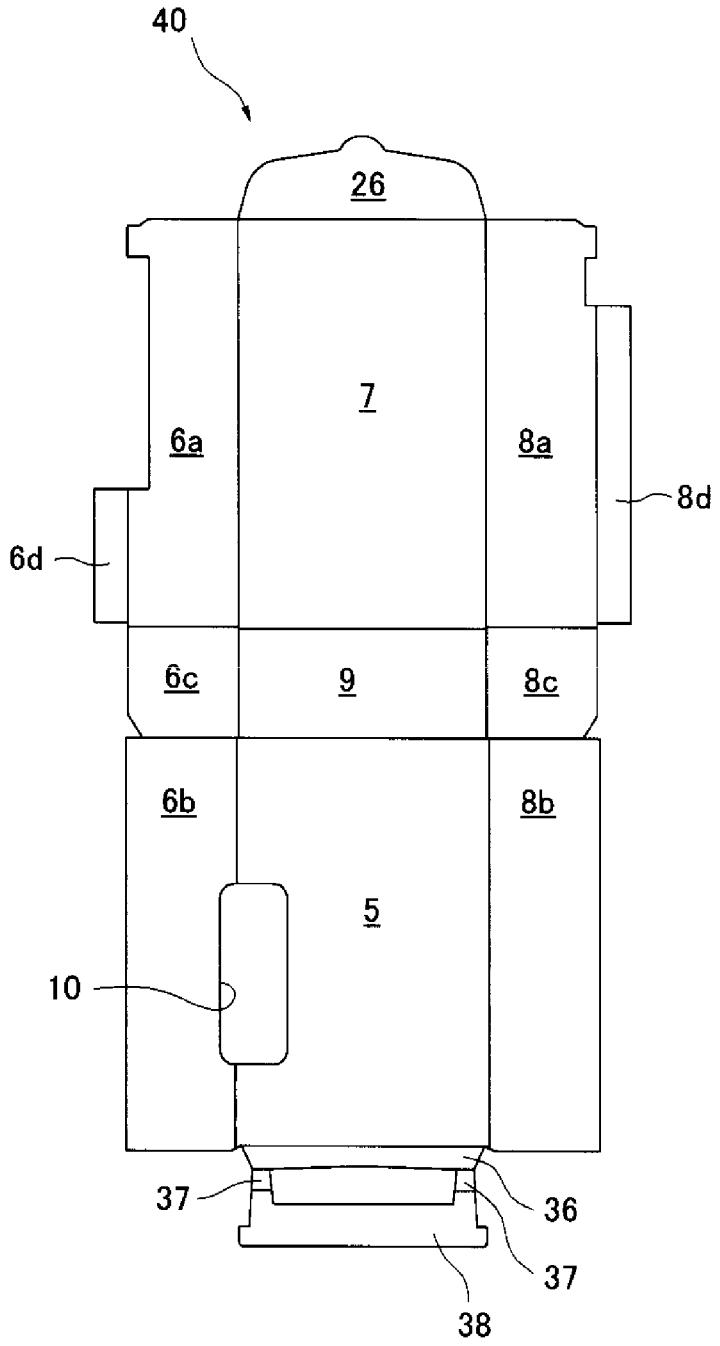
FIG. 20 is an illustrative diagram showing the blank of the outer case in the fourth embodiment.
Figure 21:
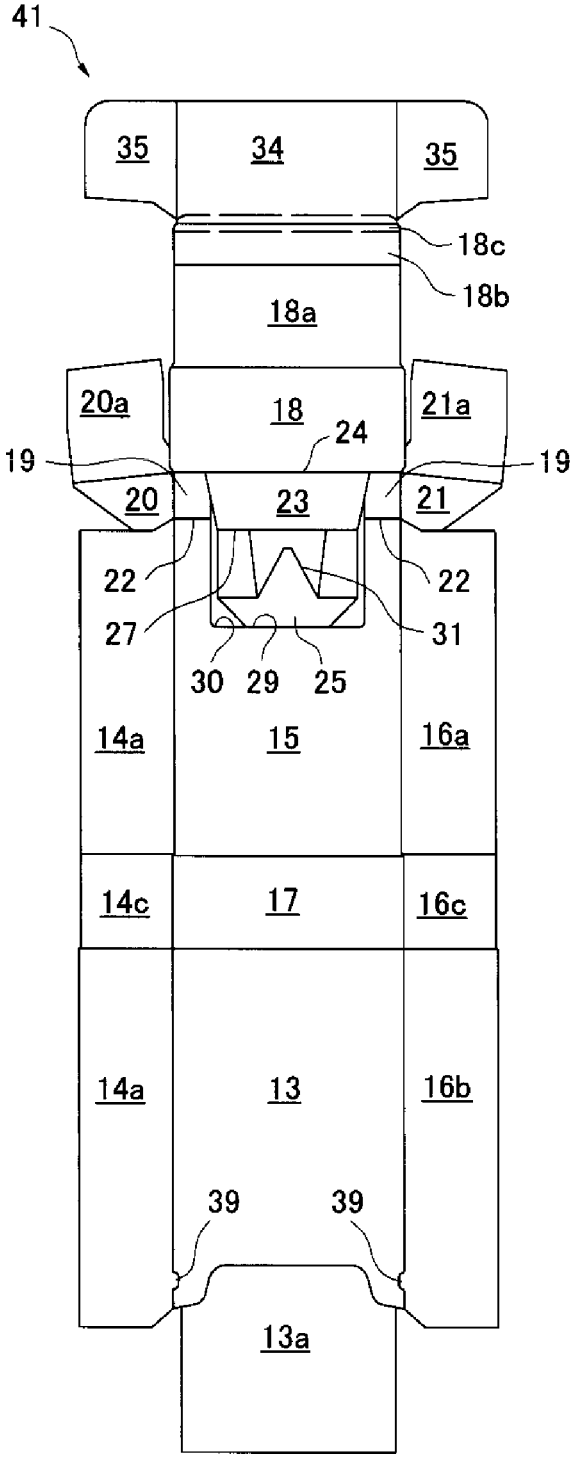
FIG. 21 is an illustrative diagram showing the blank of the inner case in the fourth embodiment.

FIG. 19 to FIG. 21 show a fourth embodiment. The fourth embodiment has the guiding means 31 that is extended downward from a lower end of the inner-case locking means 25. Then, the downward convex-shaped guiding means 31 is slidably in contact and overlapped with the inner surface of the rear-side plate 15 from the position of the incision edge being the stopper 30. The guiding means 31 guides the inner-case locking means 25 toward the stopper 30 as the lid-raising means 23 moves downward, and at a time when the inner-case locking means 25 approaches the stopper 30, the guiding means 31 guides the inner-case locking means 25 slightly toward the inner side of the inner case 3 from the position of the stopper 30.

In this manner, as the downward convex-shaped guiding means 31 is slidably in contact and overlapped with the inner surface of the rear-side plate 15 from the position of the stopper 30 and guides the inner-case locking means 25 toward the inner side of the inner case 3 when the inner-case locking means 25 approaches the position of the stopper 30, the guiding means 31 also guides the stopper-corresponding portion 33 of the outer-case locking means 26 engaged with the inner-case locking means 25 toward the stopper 30. Then, in this embodiment, as the inner-case locking means 25 is guided toward the inner surface of the rear-side plate 15 when the outer-case locking means 26 approaches the lowest position of descent, the stopper-corresponding portion 33 is in contact against the incision edge of the stopper 30 in a state of intersecting therewith, and as a result, the upward movement of the inner case 3 is regulated.

(Blanks of Fourth Embodiment)

FIG. 20 and FIG. 21 show the blanks 40 and 41 of the outer case 2 and the inner case 3 according to the fourth embodiment. Describing different constituent portions of the blanks from those of other embodiments in terms of obtaining the packaging container 1, in the inner-case locking means 25 of the inner case 3 according to this embodiment, a convex piece forming the guiding means 31 is formed by cutting a portion across from the inner-case locking means 25 to an empty space between the pair of the leg-like portions 28 into an inverted V-shape, the inner-case locking means 25 not yet being folded back. Then, by folding back the inner-case locking means 25 upward on the outer case 2 side, the downward convex-shaped guiding means 31 is formed that is in sliding contact with the rear-side plate 15. Note that, although the guiding means 31 has the inverted V-shape in the present embodiment, the shape is not necessarily limited thereto as long as the embodiment has the guiding means 31 that is in sliding contact with the inner surface of the rear-side plate 15.

(Fifth Embodiment)

Figure 22:
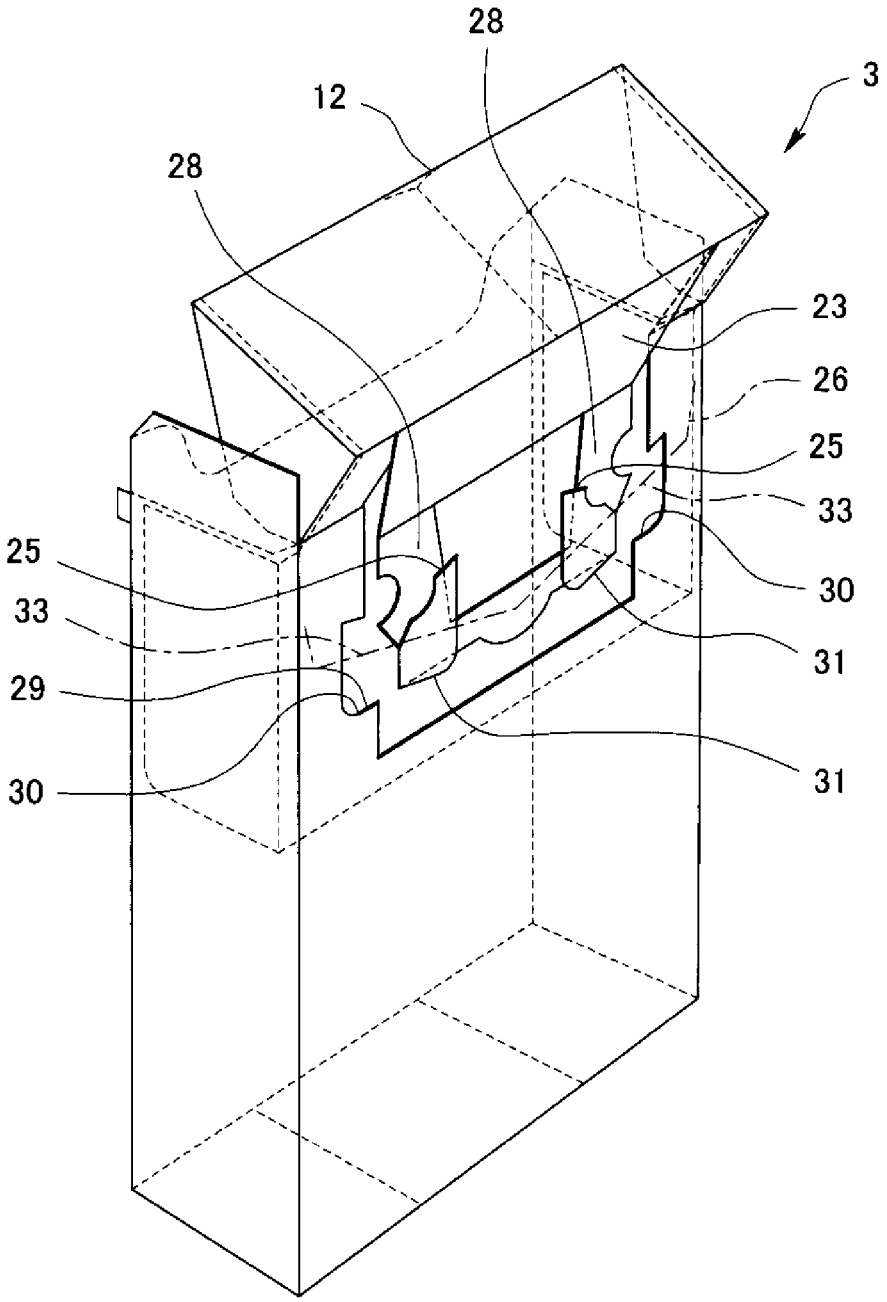
FIG. 22 is an illustrative diagram showing the lid-raising means and the guiding means in a fifth embodiment.
Figure 23:
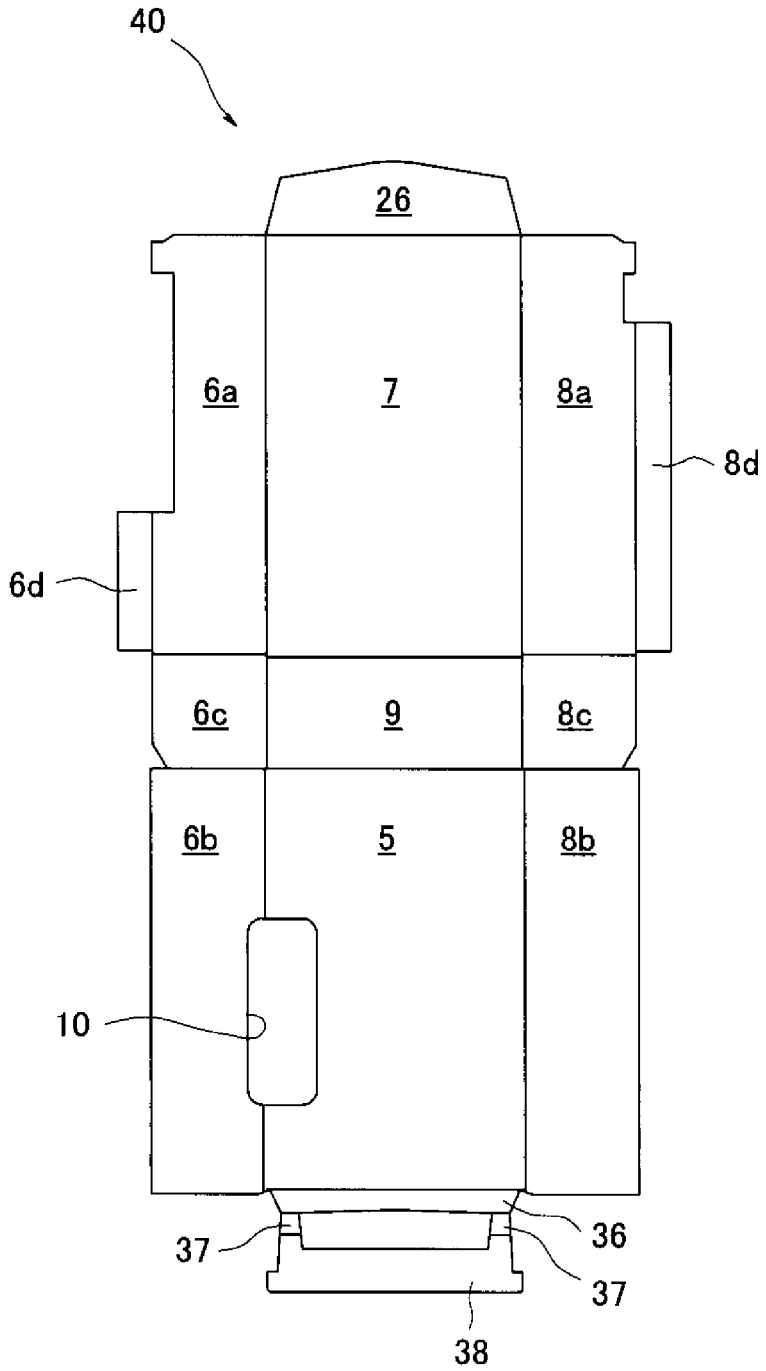
FIG. 23 is an illustrative diagram showing the blank of the outer case in the fifth embodiment.
Figure 24:
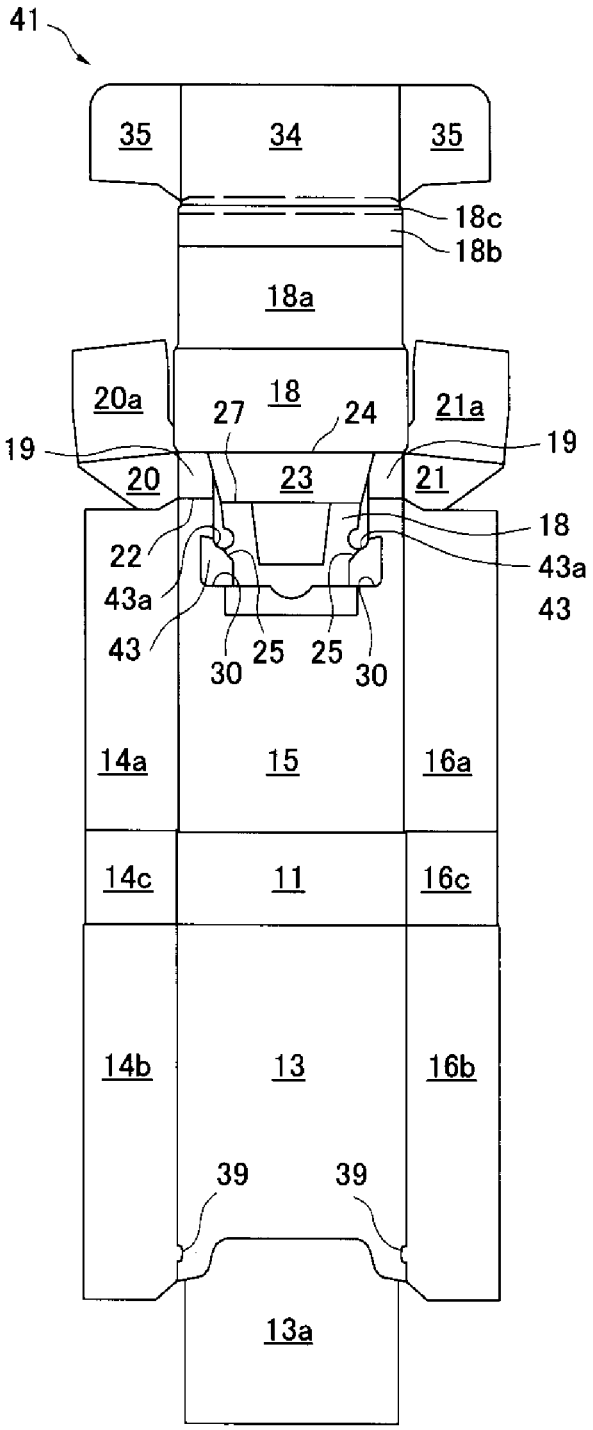
FIG. 24 is an illustrative diagram showing the blank of the inner case in the fifth embodiment.

FIG. 22 to FIG. 24 show a fifth embodiment. The inner-case locking means 25 according to the fifth embodiment is formed by upper end portions 43*a* of folded-back pieces 43 that are folded back toward a central side of the lid-raising means 23 in the width direction of the lid-raising means 23 and toward the outer case 2. The inner-case locking means 25 is given the locking function by the shape of the upper end portion 43*a*. As shown in the figures, the upper end portions 43*a* of the folded-back pieces 43, which are arranged on both sides of the lid-raising means 23, are inclined upward and across from folding bases to an outer end portion side thereof. The respective inner-case locking means 25 are folded back toward the central side of the lid-raising means 23 so as to form a locking portion of an approximate V-shape across from the leg-like portions 28 to the upper end portions 43*a*, and the locking portion of the approximate V-shape is formed as the inner-case locking means 25.

Then, the folded-back pieces 43, which are integrally provided with the inner-case locking means 25, are folded back so as to be positioned on an outer side of the rear-side plate 15 of the inner case 3, and an action to open toward the outer side of the rear-side plate 15 is generated at the folding bases of the folded-back pieces 43. Therefore, when in the form of the packaging container 1, the folded-back pieces 43 are in contact against the inner surface of the rear-side plate 7 of the outer case 2 while being slidably in contact therewith, and a reactive force against the contact causes an action of pressing against the inner-case locking means 25 toward the inner side of the rear-side plate 15 (inner case 3) to be generated.

As shown in the figures, also in this lid-raising means 23, left, right, and lower sides thereof are open so that the inner-case locking means 25 can move downward relative to the rear-side plate 15 in the same manner as in the above-described embodiments. Then, the outer-case locking means 26, which engages with the inner-case locking means 25 as the inner case 3 moves upward, is guided to a side of the folding bases by making contact with the upper end portions 43*a* of the folded-back pieces 43, and a state of the engagement is reliably formed.

As described above, the folded-back pieces 43, which are integrally provided with the inner-case locking means 25, are in contact against the inner surface of the rear-side plate 7 of the outer case 2 to urge the inner-case locking means 25 to be positioned on the inner surface side of the rear-side plate 15 of the inner case 3. The folded-back pieces 43, in which the inner-case locking means 25 is integrated, also function as the guiding means 31 by themselves. More specifically, the folded-back pieces 43 are provided so as to guide the inner-case locking means 25 and the outer-case locking means 26, which engages with the inner-case locking means 25, to the inner surface side of the rear-side plate 15, when the lid-raising means 23 moves downward in a relative manner in a state in which the outer-case locking means 26 is locked to the folded-back pieces 43.

In the fifth embodiment, the stoppers 30, against which the outer-case locking means 26 moving downward is in contact, are formed by an incision edge on a lower edge side of an opening portion that is obtained by forming the folded-back pieces 43 by cutting and folding them up. Therefore, also in the fifth embodiment, the stoppers 30 are formed below the height position of the inner-case locking means 25, while having the incision edge as the upper end edge thereof, in the same manner as in the above-described embodiments. The stoppers 30 are positioned on left and right sides of the lid-raising means 23 while being biased toward sides of the inner case 3. In this manner, although there is an open space between the left and right stoppers 30, it is needless to say that the width of the outer-case locking means 26 is larger than a length of the stopper, which is a distance between the outermost ends of the stopper 30.

Then, as a portion of the outer-case locking means 26 corresponding to the lid-raising means 23 engages with the inner-case locking means 25 so that the portion moves downward in a state of being guided to the inner surface of the rear-side plate 15 of the inner case 3, the stopper-corresponding portions 33 of the outer-case locking means 26 move downward on the stoppers 30, respectively, while being arranged to intersect with the incision edge that forms the upper end edge of the stoppers 30. The upward movement of the inner case 3 is regulated by the stopper-corresponding portions 33 being in contact against the stoppers 30.

(Blanks of Fifth Embodiment)

FIG. 23 and FIG. 24 show the blanks 40 and 41 of the outer case 2 and the inner case 3 according to the fifth embodiment. Describing different constituent portions of the blanks from those of other embodiments in terms of obtaining the packaging container 1, the folded-back pieces 43, which form the inner-case locking means 25 of the inner case 3 in this embodiment, are extended toward the left and right sides of the lid-raising means 23 and are formed by cutting so as to reach areas of the rear-side plate 15 on the sides of the lid-raising means. Then, as described above, the upper end portions 43*a* of the folded-back pieces 43 are inclined upward from the side of the folding bases of the folded-back pieces 43, and the folded-back pieces 43 are folded back so that the upper end portions 43*a* form the inner-case locking means 25 and the guiding means 31 is formed by the folded-back pieces 43 at the same time.

(Sixth Embodiment)

Figure 25:
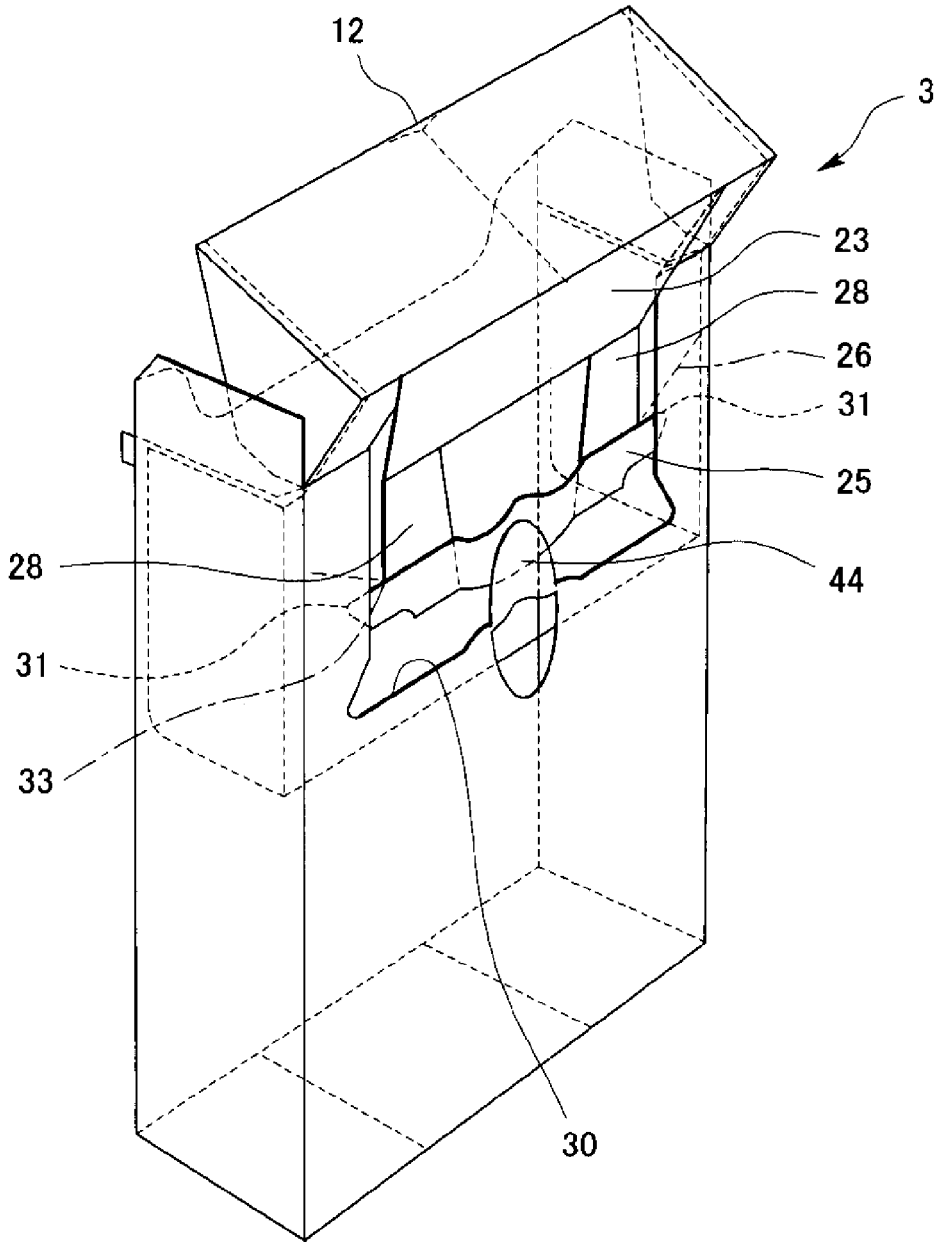
FIG. 25 is an illustrative diagram showing lid-raising means and guiding means in a sixth embodiment.
Figure 26:
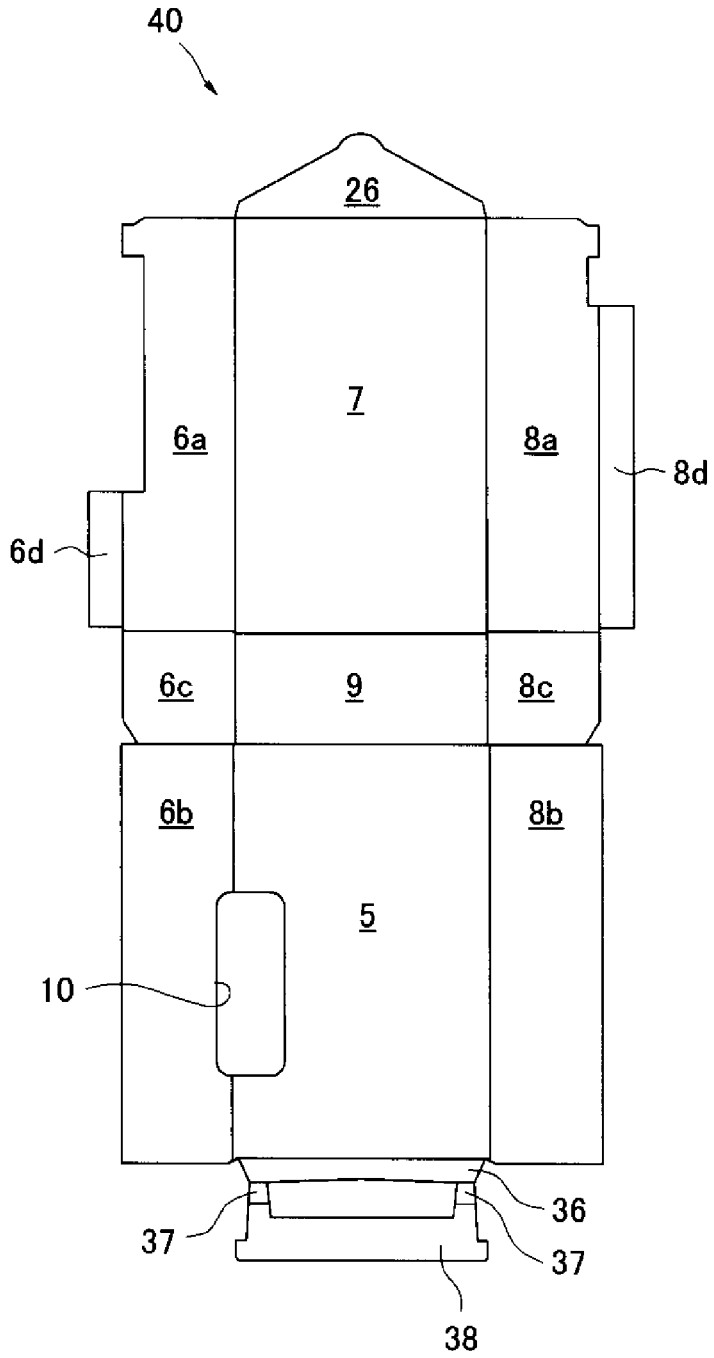
FIG. 26 is an illustrative diagram showing the blank of the outer case in the sixth embodiment.
Figure 27:
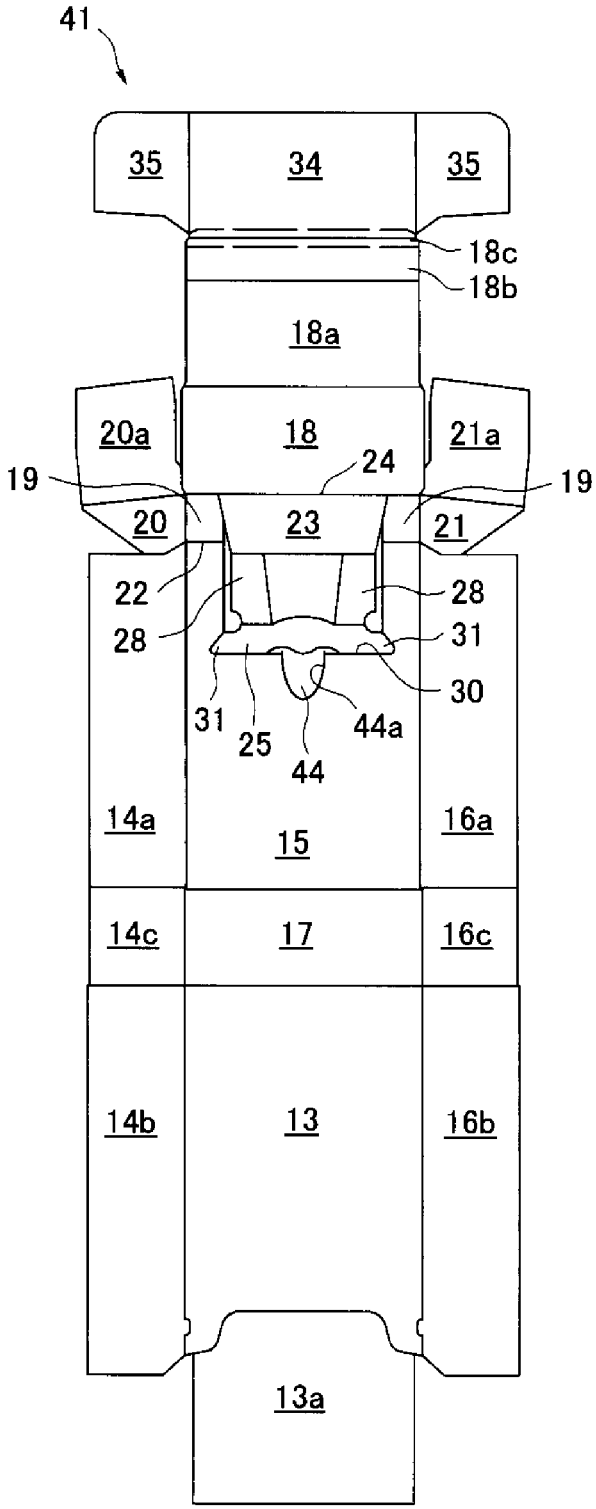
FIG. 27 is an illustrative diagram showing the blank of the inner case in the sixth embodiment.
Figure 28:
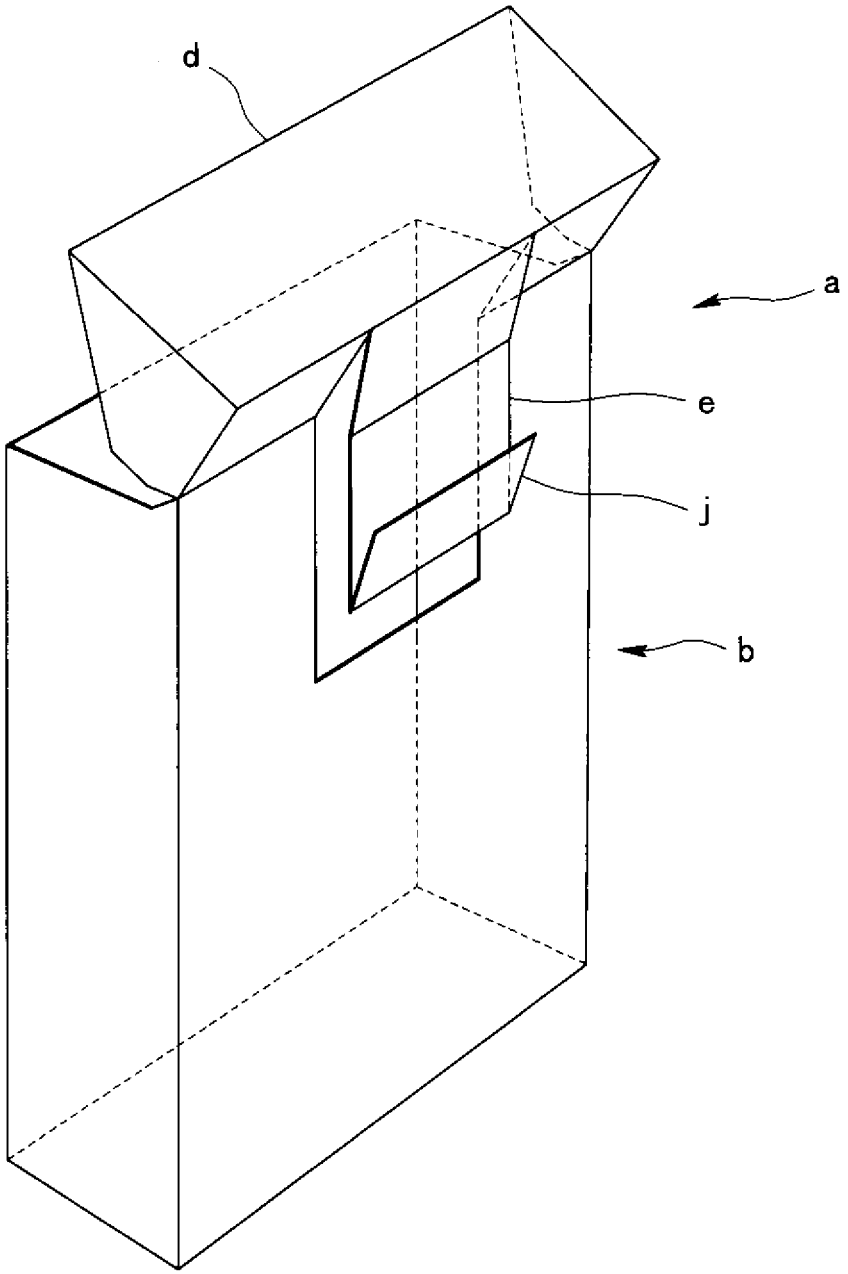
FIG. 28 is an illustrative diagram showing lid-raising means in an inner case in a conventional example in a state viewed from behind.
Figure 29:
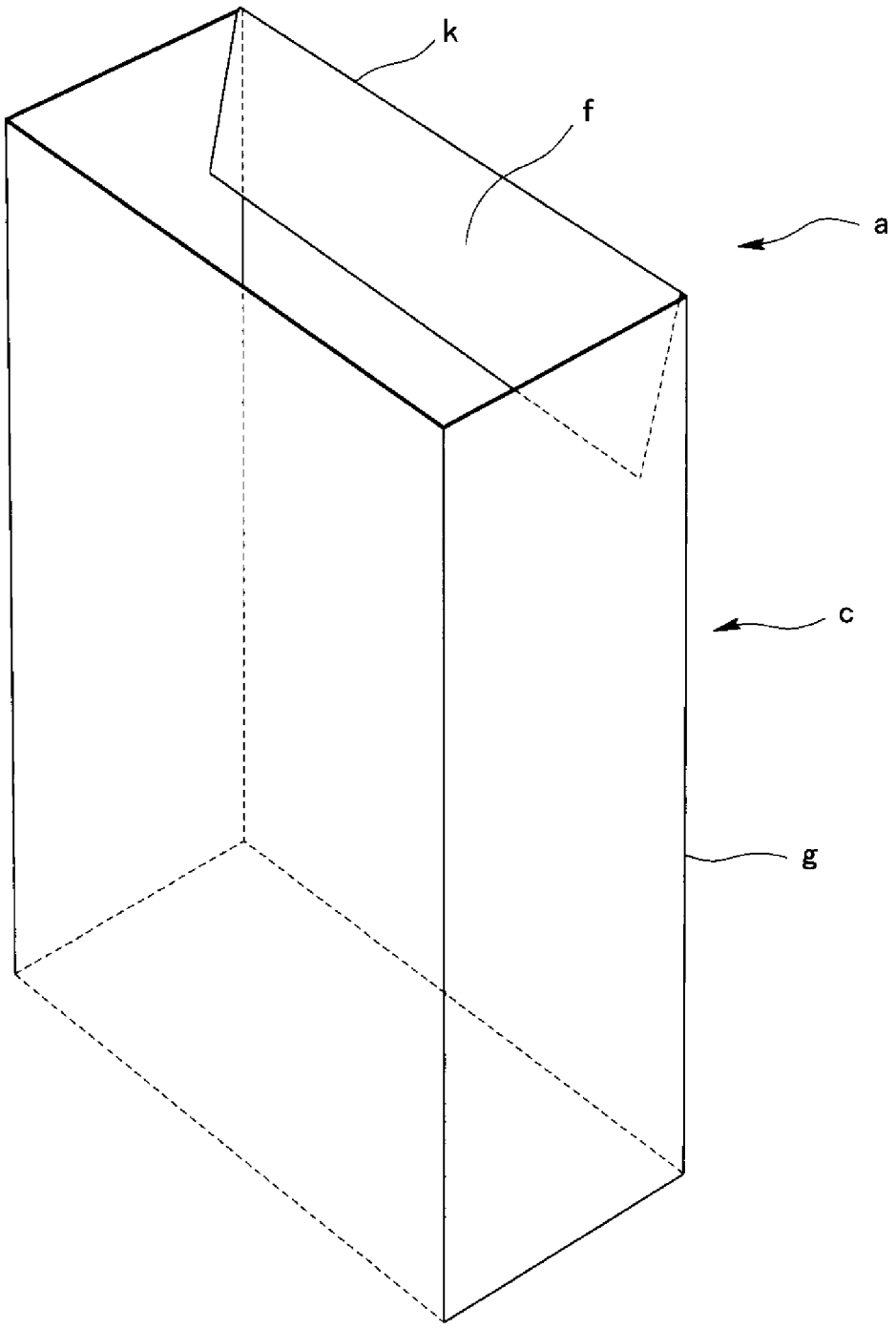
FIG. 29 is an illustrative diagram showing locking means of an insertion and removal opening in the outer case in the conventional example.
Figure 30:
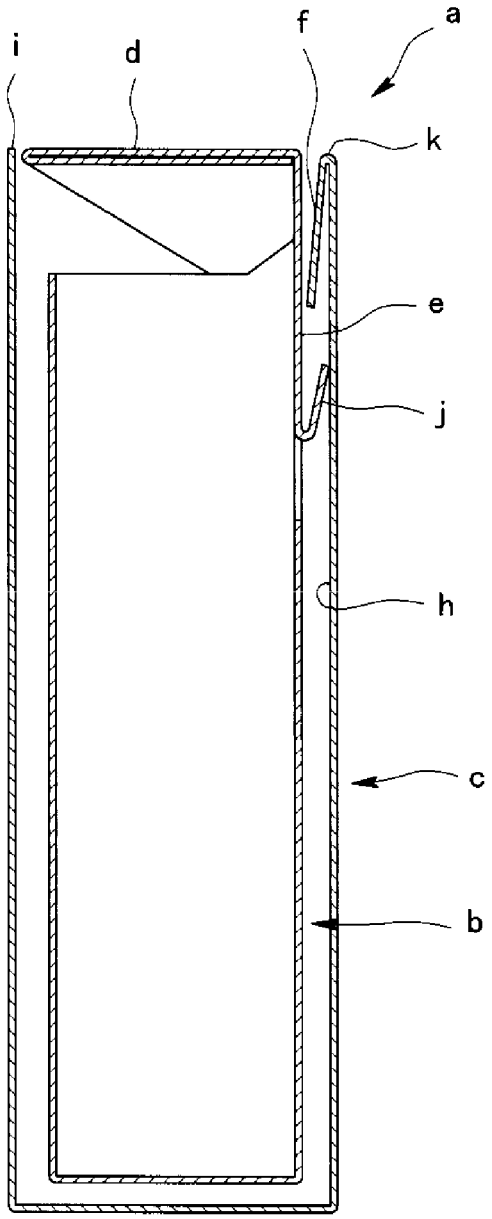
FIG. 30 is an illustrative diagram showing a state in which the inner case is housed inside the outer case in the conventional example.
Figure 31:
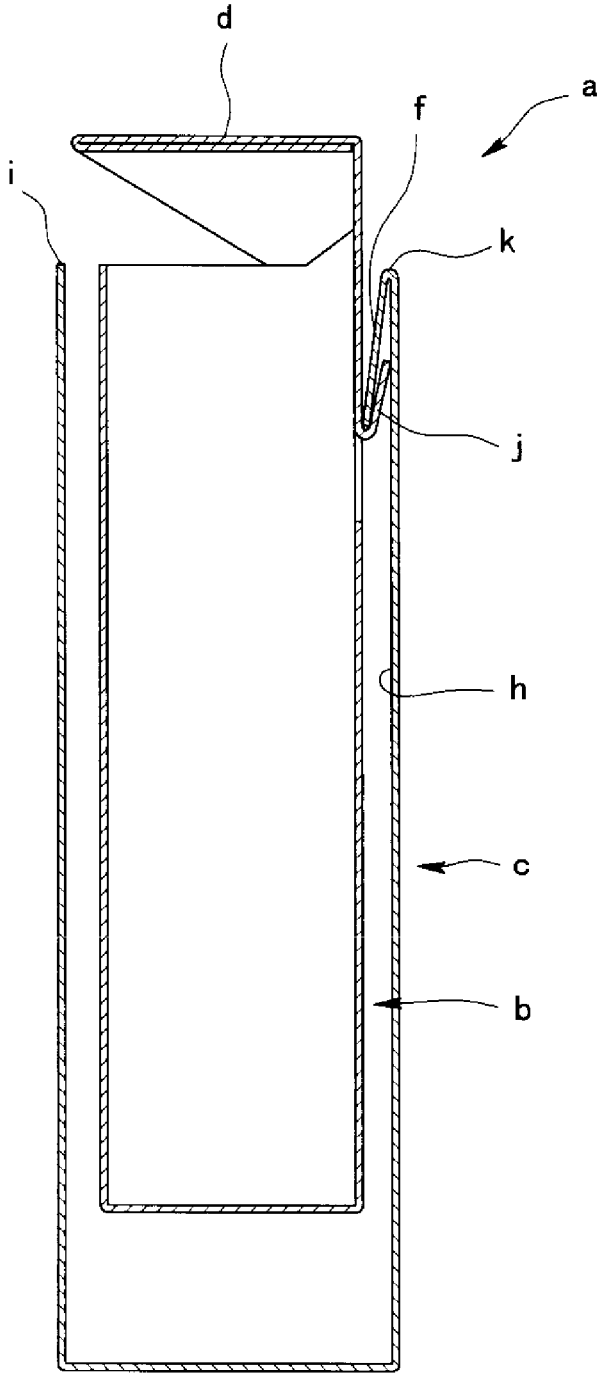
FIG. 31 is an illustrative diagram showing a state in which the inner case moves upward from the outer case in the conventional example.
Figure 32:
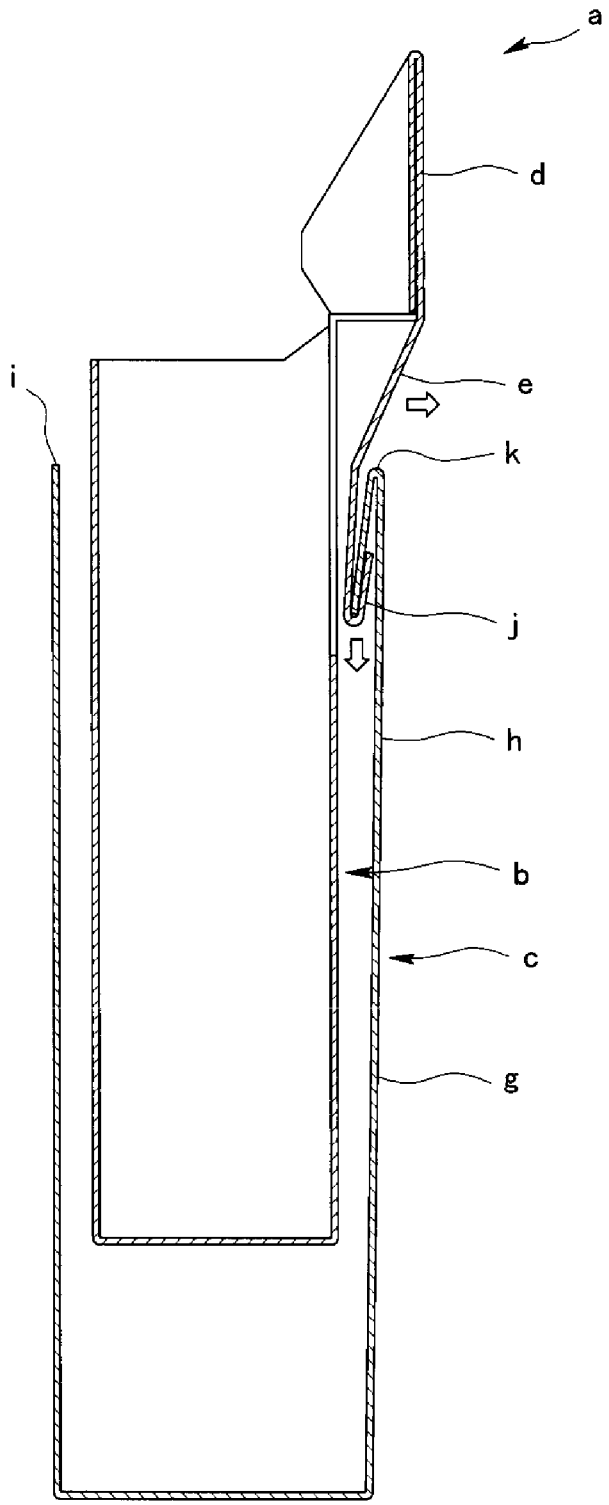
FIG. 32 is an illustrative diagram showing a state in which an opening and closing lid is open in the conventional example.

FIG. 25 to FIG. 27 show a sixth embodiment. Although, in the first embodiment, the inner-case locking means 25 is formed by folding back the lower portion of the lid-raising means 23, and further, the guiding means 31 is formed by the convex piece by extending one of the side portions of the inner-case locking means 25 sideways, in the sixth embodiment, convex pieces are provided on both of the side portions of the inner-case locking means 25 and the respective convex pieces form the guiding means 31. In the sixth embodiment, as the guiding means 31 is provided on both of the sides of the inner-case locking means 25, the guidance of the inner-case locking means 25 and the stopper-corresponding portion 33 of the outer-case locking means 26 toward the stopper 30 is performed more appropriately.

Further, in the sixth embodiment, second guiding means 44 is provided in the inner case 3, wherein the second guiding means 44 is overlapped with the inner case 3 from the direction that becomes the side of the outer case 2 with respect to the inner-case locking means 25. The second guiding means 44 is formed by a tongue piece that is formed by cutting a portion of the rear-side plate 15 of the inner case 3 below the inner-case locking means 25 into a downward convex and approximate U-shape and rotating the portion upward from below through an outer side of the inner case while having a portion adjacent to the opening edge below the inner-case locking means 25 as a connection portion.

As the shape of the connection portion, which forms a base end rotation portion of the tongue piece, is small and the base end rotation portion of the tongue piece is provided so that the height thereof roughly matches that of the opening edge below the inner-case locking means 25, the second guiding means 44 has a base end thereof at the height position of the stopper 30.

Further, as the second guiding means 44 overlaps with the inner-case locking means 25, which is slightly open, when the second guiding means 44 is combined with the outer case 2, the second guiding means 44 is in a state of almost standing up while an upper end thereof is in contact against the inner surface of the rear-side plate 7 of the outer case 2. Therefore, as described above, the inner-case locking means 25 and the outer-case locking means 26 engage with each other as the inner case 3 moves upward, and the inner-case locking means 25 that is in a state of engagement with the outer-case locking means 26 is provided so as to move downward (relative movement) while being in sliding contact with the second guiding means 44 when moving downward.

Then, as described above, as the second guiding means 44 stands up from the height position of the stopper 30 and also has both sides thereof formed as the stopper 30 as shown in the figures, the inner-case locking means 25 that is in a state of engagement with the outer-case locking means 26 is guided to a surface of the second guiding means 44 on the inner side of the inner case so as to approach the stopper 30 and to be guided downward in a state of being positioned closer to the inner side of the inner case 3. As a result, the stopper-corresponding portion 33 of the outer-case locking means 26 is in contact against the stopper 30 in a state of intersecting with each other, and the upward movement of the inner case 3 is stopped.

(Blanks of Sixth Embodiment)

FIG. 26 and FIG. 27 show the blanks 40 and 41 of the outer case 2 and the inner case 3 according to the sixth embodiment and show a portion in which the guiding means 31 and the second guiding means 44 are obtained. More specifically, the guiding means 31 in the inner case 3 according to the sixth embodiment is formed by extending both the side portions of the inner-case locking means 25 sideways and cutting the extended side portions so as to obtain a convex-shaped tongue piece. The guiding means 31 is formed at the same time when the inner-case locking means 25 is formed by being folded back. The inner-case locking means 25 and the guiding means 31 are respectively locked to the inner surface side of the rear-side plate 15 of the inner case 3 while being slidably in contact therewith. Further, as described above, an approximate U-shaped cut 44*a* is provided in the second guiding means 44 so that an end portion of the second guiding means 44 approaches the incision edge that forms the stopper 30. The second guiding means 44 is obtained by making the tongue piece portion obtained by the cut 44*a* stand up as described above.

In each of the above-described embodiments, the packaging container is shown that has angled corners around the body thereof, but the present invention is not limited to those embodiments and the packaging container may have slightly rounded corners. Further, a portion corresponding to the slide operation opening 10 of the inner case 3 may be subjected to emboss processing so as to improve the finger gripability.

Further, in each of the above-described embodiments, the inner case 3 with the body portion itself surrounded by four side plates is illustrated as an example, but the present invention is not limited thereto. For example, the inner case 3 may have an approximate ship-like shape by forming a surface of the inner case 3 corresponding to the front-side plate 5 of the outer case 2 as an open portion continuous to the removal opening. In this case, the slide operation opening 10 may be provided on one of the left-side plate or the right-side plate of the outer case 2 so that the user can slide one of the left-side plate and the right-side plate of the inner case 3 exposed through the slide operation opening 10 using the tip of the finger.

In each of the above-described embodiments, the slide operation opening 10 is provided across two side plates, i.e., from the front-side plate 5 to the right-side plate 6, but the position of the slide operation opening 10 is not necessarily limited thereto. For example, the slide operation opening 10 can be provided in the right-side plate 6 or the left-side plate 8. Further, although each of the packaging containers is described as paper-made, a packaging material for obtaining the packaging container need not necessarily be paper.

The invention claimed is:

1. A packaging container with an opening and closing lid, the packaging container comprising an outer case of a rectangular parallelepiped shape having an insertion and removal opening in an upper portion thereof and an inner case which is slidably housed in the outer case, can be inserted and removed from the insertion and removal opening, and has an opening and closing lid, a lower portion of which is rotatably connected to the inner case via a first hinge, a lid-raising means which has an upper portion connected to a rear end of the opening and closing lid via a second hinge, can move relative to the inner case as the opening and closing lid rotates, and has inner-case locking means arranged therein on a side facing an inner surface of the outer case, and outer-case locking means which is positioned on an inner side of the outer case and can be engaged with the inner-case locking means, wherein:

the packaging container with the opening and closing lid is configured such that the inner-case locking means and the outer-case locking means engage with each other as the inner case moves upward, and the lid-raising means moves downward as the inner case moves upward in a state in which the inner-case locking means and the outer-case locking means engage with each other so that the opening and closing lid rotates in an opening direction; and the packaging container with the opening and closing lid is characterized in that an incision opening is formed by cutting a part corresponding to an edge of the lid-raising means in a rear side plate of the inner case, a stopper formed in a part of the incision opening below a height position of the inner-case locking means with an upper end edge of the stopper being an incision edge arranged at the lowest position of descent of the outer-case locking means, and a width of the outer-case locking means is wider than that of the stopper, and at least part of a stopper-corresponding portion of the outer-case locking means, which the stopper approaches as the inner case moves upward, is in contact against the incision edge being the stopper, guiding means for guiding the stopper-corresponding portion of the outer-case locking means toward the stopper is provided in the inner case, wherein the guiding means is provided in the lid-raising means and guiding the inner-case locking means toward the stopper while being slidably in contact with an inner surface of the inner case, the inner-case locking means approaching the stopper as the inner case moves upward, wherein the guiding means presses against the inner-case locking means toward an inner side of the inner case.

2. The packaging container with an opening and closing lid according to claim 1, wherein a backing plate is arranged on an inner surface of a side plate, in which the lid-raising means of the inner case is provided, the backing plate covering the lid-raising means and the incision opening formed around the edge of the lid-raising means.

3. The packaging container with an opening and closing lid according to claim 1, wherein a slide operation opening is opened in a body portion of the outer case so that a part of the inner case is exposed from the slide operation opening, thereby being enabled to perform a slide-up operation with respect to the exposed part of the inner case.

4. A packaging container with an opening and closing lid, the packaging container comprising:

an outer case of a rectangular parallelepiped shape having an insertion and removal opening in an upper portion thereof and an inner case which is slidably housed in the outer case, can be inserted and removed from the insertion and removal opening, and has an opening and closing lid, a lower portion of which is rotatably connected to the inner case via a first hinge, a lid-raising means which has an upper portion connected to a rear end of the opening and closing lid via a second hinge, can move relative to the inner case as the opening and closing lid rotates, and has inner-case locking means arranged therein on a side facing an inner surface of the outer case, and outer-case locking means which is positioned on an inner side of the outer case and can be engaged with the inner-case locking means, wherein:

the packaging container with the opening and closing lid is configured such that the inner-case locking means and the outer-case locking means engage with each other as the inner case moves upward, and the lid-raising means moves downward as the inner case moves upward in a state in which the inner-case locking means and the outer-case locking means engage with each other so that the opening and closing lid rotates in an opening direction; and the packaging container with the opening and closing lid is characterized in that an incision opening is formed by cutting a part corresponding to an edge of the lid-raising means in a rear side plate of the inner case, a stopper formed in a part of the incision opening below a height position of the inner-case locking means with an upper end edge of the stopper being an incision edge arranged at the lowest position of the outer-case locking means, and a width of the outer-case locking means is wider than that of the stopper, and at least part of a stopper-corresponding portion of the outer-case locking means, which the stopper approaches as the inner case moves upward, is in contact against the incision edge being the stopper, wherein a backing plate is arranged on an inner surface of a side plate, in which the lid-raising means of the inner case is provided, the backing plate covering the lid-raising means and the incision opening formed around the edge of the lid-raising means.

5. A packaging container with an opening and closing lid, the packaging container comprising:

an outer case of a rectangular parallelepiped shape having an insertion and removal opening in an upper portion thereof and an inner case which is slidably housed in the outer case, can be inserted and removed from the insertion and removal opening, and has an opening and closing lid, a lower portion of which is rotatably connected to the inner case via a first hinge, a lid-raising means which has an upper portion connected to a rear end of the opening and closing lid via a second hinge, can move relative to the inner case as the opening and closing lid rotates, and has inner-case locking means arranged therein on a side facing an inner surface of the outer case, and outer-case locking means which is positioned on an inner side of the outer case and can be engaged with the inner-case locking means, wherein:

the packaging container with the opening and closing lid is configured such that the inner-case locking means and the outer-case locking means engage with each other as the inner case moves upward, and the lid-raising means moves downward as the inner case moves upward in a state in which the inner-case locking means and the outer-case locking means engage with each other so that the opening and closing lid rotates in an opening direction; and the packaging container with the opening and closing lid is characterized in that an incision opening is formed by cutting a part corresponding to an edge of the lid-raising means in a rear side plate of the inner case, a stopper formed in a part of the incision opening below a height position of the inner-case locking means with an upper end edge of the stopper being an incision edge arranged at the lowest position of descent of the outer-case locking means, and a width of the outer-case locking means is wider than that of the stopper, and at least part of a stopper-corresponding portion of the outer-case locking means, which the stopper approaches as the inner case moves upward, is in contact against the incision edge being the stopper, wherein a slide operation opening is opened in a body portion of the outer case so that a part of the inner case is exposed from the slide operation opening, thereby being enabled to perform a slide-up operation with respect to the exposed part of the inner case.

* * * * *

UNITED STATES PATENT AND TRADEMARK OFFICE

CERTIFICATE OF CORRECTION

PATENT NO. : 9,254,938 B2
APPLICATION NO. : 14/447880
DATED : February 9, 2016
INVENTOR(S) : Shinichi Iwata et al.

It is certified that error appears in the above-identified patent and that said Letters Patent is hereby corrected as shown below:

ON THE TITLE PAGE:

At item (56), References Cited, insert the following in the section identified as U.S. PATENT DOCUMENTS:

-- 3,400,874 9/1968 Shimada et al. --.

At item (56), References Cited, insert the following in the section identified as FOREIGN PATENT DOCUMENTS:

| | | |
|---|---|---|
| -- DE | 1285948 B | 12/1968 |
| DE | 2809548 A1 | 9/1978 |
| NL | 6611342 A | 6/1967 --. |

At item (56), References Cited, insert the following:

-- OTHER PUBLICATIONS

European Search Report issued on Aug. 31, 2015, for European Application No. 12867033.8. --.

Signed and Sealed this
Twelfth Day of July, 2016

Michelle K. Lee

Michelle K. Lee
*Director of the United States Patent and Trademark Office*